US011646508B2

(12) United States Patent
Yamanashi et al.

(10) Patent No.: US 11,646,508 B2
(45) Date of Patent: May 9, 2023

(54) CONNECTOR

(71) Applicant: Yazaki Corporation, Tokyo (JP)

(72) Inventors: Daisuke Yamanashi, Shizuoka (JP); Takashi Sone, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 50 days.

(21) Appl. No.: 17/350,209

(22) Filed: Jun. 17, 2021

(65) Prior Publication Data

US 2021/0399442 A1 Dec. 23, 2021

(30) Foreign Application Priority Data

Jun. 23, 2020 (JP) ..... JP2020-107780

(51) Int. Cl.

| | |
|---|---|
| ***H01R 4/34*** | (2006.01) |
| ***H01R 9/18*** | (2006.01) |
| ***H01R 13/502*** | (2006.01) |
| ***H01R 13/52*** | (2006.01) |

(52) U.S. Cl.

CPC ..... *H01R 4/34* (2013.01); *H01R 9/18* (2013.01); *H01R 13/502* (2013.01); *H01R 13/521* (2013.01)

(58) Field of Classification Search

CPC ..... H01R 4/34; H01R 9/18; H01R 13/502; H01R 13/521; H01R 4/305; H01R 9/223; H01R 2105/00; H01R 13/621; H01R 13/46; H01R 13/639; H01R 24/00

See application file for complete search history.

(56) References Cited

U.S. PATENT DOCUMENTS

| | | | | |
|---|---|---|---|---|
| 8,342,880 | B2 * | 1/2013 | Kato | H01R 13/4226 439/382 |
| 9,017,099 | B2 * | 4/2015 | Ikeda | H01R 13/521 439/559 |
| 9,484,647 | B2 * | 11/2016 | Ishikawa | H01R 9/24 |
| 9,570,899 | B2 * | 2/2017 | Tanaka | H02G 15/013 |
| 9,966,715 | B2 * | 5/2018 | Ishibashi | H01R 27/02 |
| 2010/0009566 | A1 * | 1/2010 | Sakakura | H01R 4/34 439/364 |

(Continued)

FOREIGN PATENT DOCUMENTS

| | | |
|---|---|---|
| EP | 2 144 332 A1 | 1/2010 |
| JP | 2012-243636 A | 12/2012 |

(Continued)

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

A connector includes: a plate-shaped conductor having a through hole through which a fastening member is inserted; a housing holding the conductor and having an abutment surface; a nut having a screw hole into which the fastening member is screwed, and fixed to the housing along a first direction that is a direction in which the conductor extends; a support member fixed to the housing and restricting the nut from escaping from the housing; and a holding structure holding the nut, wherein the abutment surface is a surface against which a side surface of the nut abuts, such that the screw hole is positioned to be concentric with the through hole, and the holding structure holds the nut in a state where the side surface of the nut abuts against the abutment surface.

15 Claims, 20 Drawing Sheets

(56) References Cited

U.S. PATENT DOCUMENTS

| | | | | |
|---|---|---|---|---|
| 2013/0322049 | A1* | 12/2013 | Ishikawa | H01R 13/502 361/823 |
| 2014/0024239 | A1* | 1/2014 | Tanaka | H01R 13/521 439/271 |
| 2014/0322973 | A1* | 10/2014 | Okamoto | H01R 13/4223 439/587 |
| 2018/0175534 | A1* | 6/2018 | Sugiyama | H01R 13/719 |
| 2018/0323521 | A1 | 11/2018 | Yokotani | |
| 2018/0358748 | A1* | 12/2018 | Yamanashi | H01R 24/62 |
| 2021/0399442 | A1* | 12/2021 | Yamanashi | H01R 4/305 |
| 2021/0399511 | A1* | 12/2021 | Yamanashi | H01R 43/005 |

FOREIGN PATENT DOCUMENTS

| | | | |
|---|---|---|---|
| JP | 2015-26517 | A | 2/2015 |
| WO | 2012/105655 | A1 | 8/2012 |

* cited by examiner

CONNECTOR

CROSS-REFERENCE TO RELATED APPLICATION(S)

The present application claims priority to and incorporates by reference the entire contents of Japanese Patent Application No. 2020-107780 filed in Japan on Jun. 23, 2020.

BACKGROUND OF THE INVENTION

1. Field of the Invention

The present invention relates to a connector.

2. Description of the Related Art

Conventionally, there has been a connector including a terminal and a nut. Japanese Patent Application Laid-open No. 2012-243636 discloses a connector including a housing having a terminal insertion hole, a terminal inserted into the terminal insertion hole, and a fastening nut fastening and fixing a mating terminal to the terminal. In Japanese Patent Application Laid-open No. 2012-243636, a fastening hole is formed in an end portion of the terminal.

Here, if the position of the nut with respect to the terminal deviates from a normal position, workability during fastening work is decreased. It is desired to position the nut at the normal position.

SUMMARY OF THE INVENTION

An object of the present invention is to provide a connector capable of positioning a nut at a normal position.

In order to achieve the above mentioned object, a connector according to one aspect of the present invention includes a plate-shaped conductor having a through hole through which a fastening member is inserted; a housing holding the conductor and having an abutment surface; a nut having a screw hole into which the fastening member is screwed, and fixed to the housing along a first direction that is a direction in which the conductor extends; a support member configured to be fixed to the housing and restrict the nut from failing off the housing; and a holding structure configured to hold the nut, wherein the abutment surface is a surface configured to position the screw hole concentric with the through hole in a state where a side surface of the nut abuts the abutment surface, and the holding structure holds the nut in a state where the side surface of the nut abuts the abutment surface.

According to another aspect of the present invention, in the connector, it is preferable that the holding structure has a holding recess provided in the housing and recessed in the first direction to make the nut be press-fitted into the holding recess, and the abutment surface is positioned deep in the holding recess.

According to still another aspect of the present invention, in the connector, it is preferable that the holding structure has a rib that is provided on a wall surface of the holding recess along the first direction and is configured to be squashed by the nut when the nut is press-fitted into the holding recess.

According to still another aspect of the present invention, in the connector, it is preferable that the support member has a support piece configured to support the nut, and is configured to be fixed to the housing in a state where the nut is supported by the support piece.

According to still another aspect of the present invention, in the connector, it is preferable that side surfaces of the nut include a first side surface abutting the abutment surface, the first side surface has a larger width than a width of the abutment surface, the support piece include first support pieces facing end portions of the first side surface in the first direction and supporting the first side surface, and the housing has accommodation recesses adjacent to the abutment surface and configured to accommodate the first support pieces.

According to still another aspect of the present invention, in the connector, it is preferable that side surfaces of the nut include a first side surface abutting the abutment surface and a second side surface facing opposite to the first side surface, the support piece include a second support piece facing the second side surface, and the second support piece is configured to support the nut such that a part of the second side surface is exposed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a connector according to an embodiment of the present invention will be described in detail with reference to the drawings. It should be noted that the present invention is not limited by the embodiment. In addition, components in the following embodiment include components that can be easily assumed by those skilled in the art or components that are substantially identical thereto.

Embodiment

Figure 1:
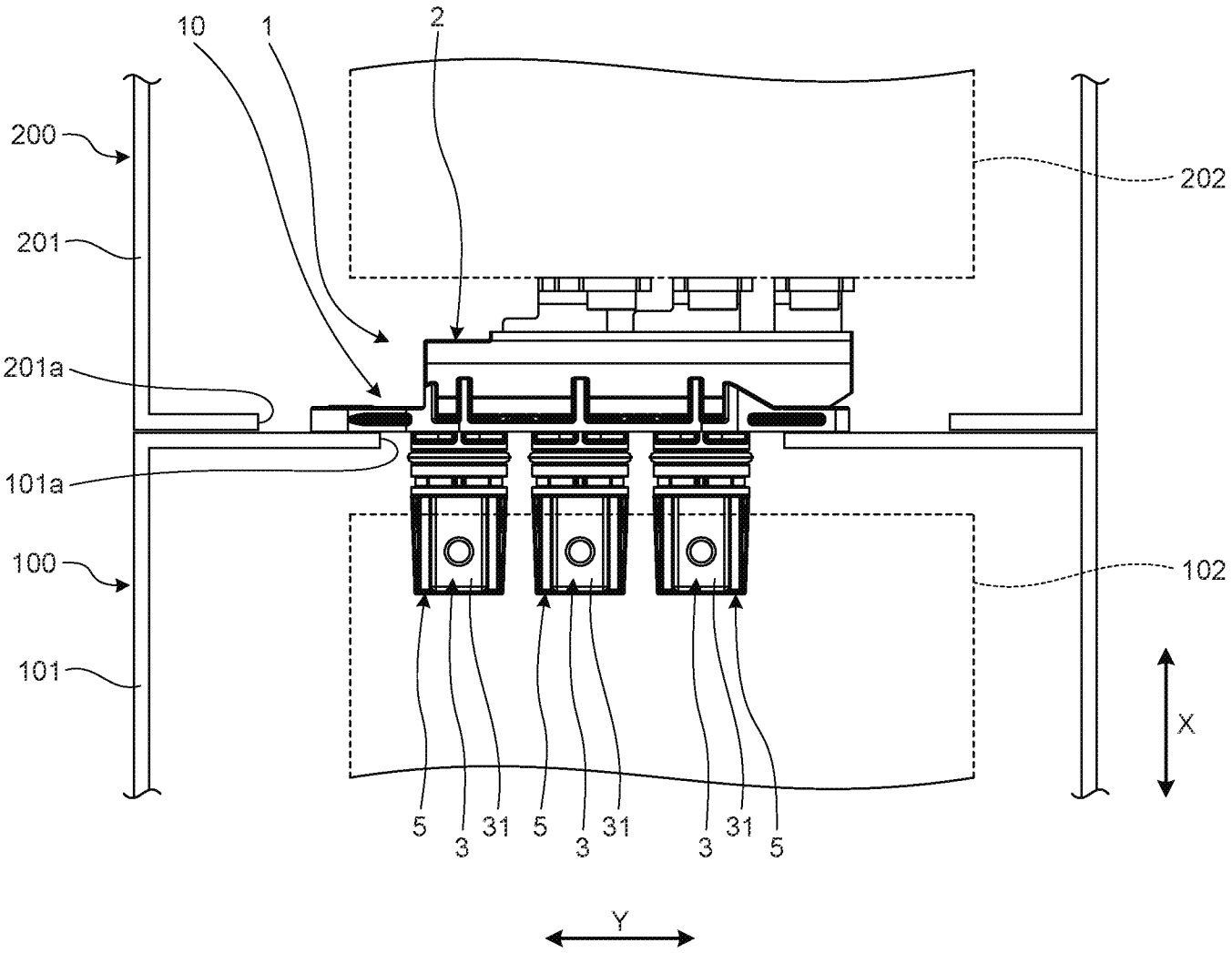
FIG. 1 is a view illustrating an arrangement example of a connector according to an embodiment.
Figure 2:
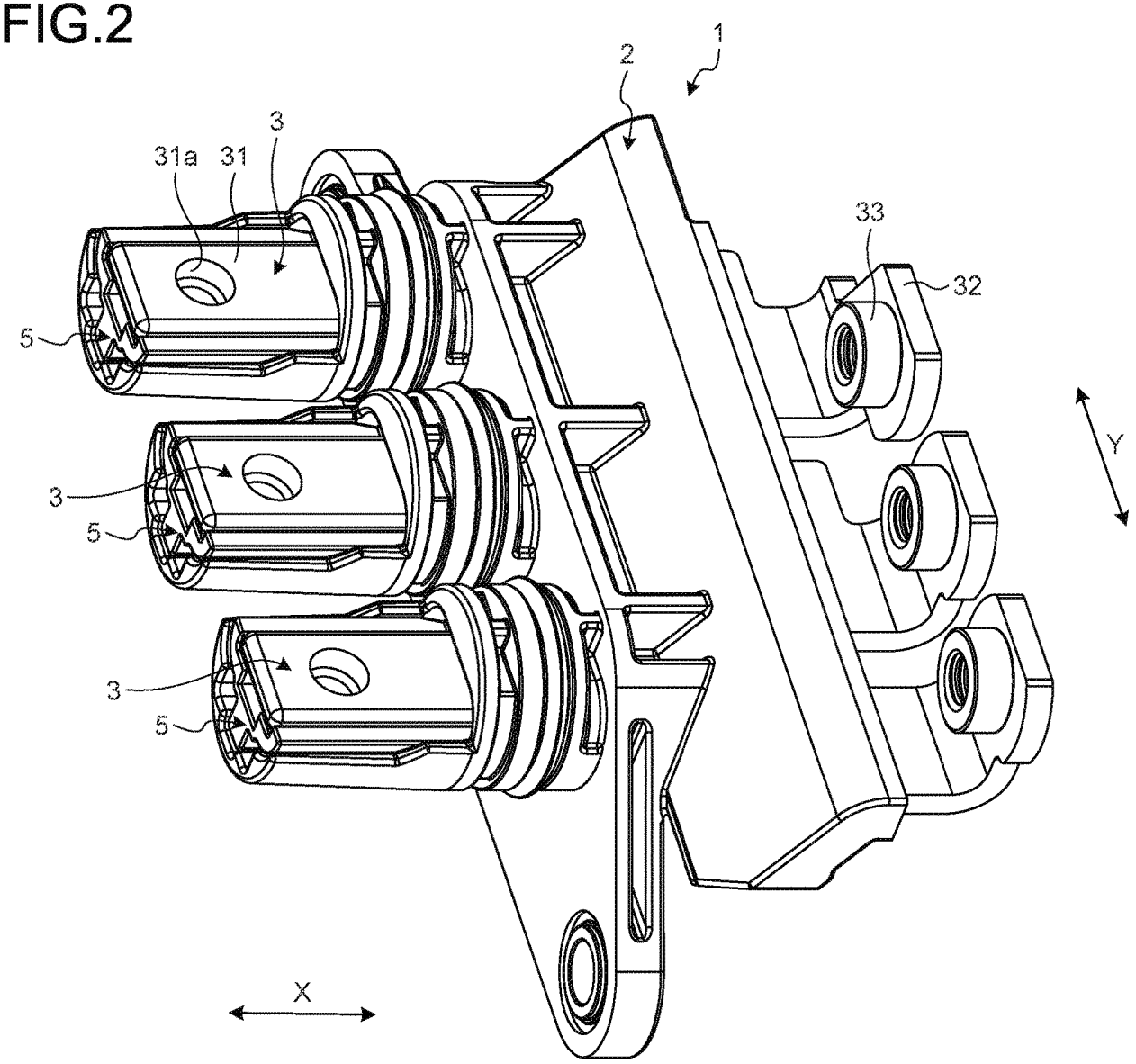
FIG. 2 is a perspective view of the connector according to the embodiment.
Figure 3:
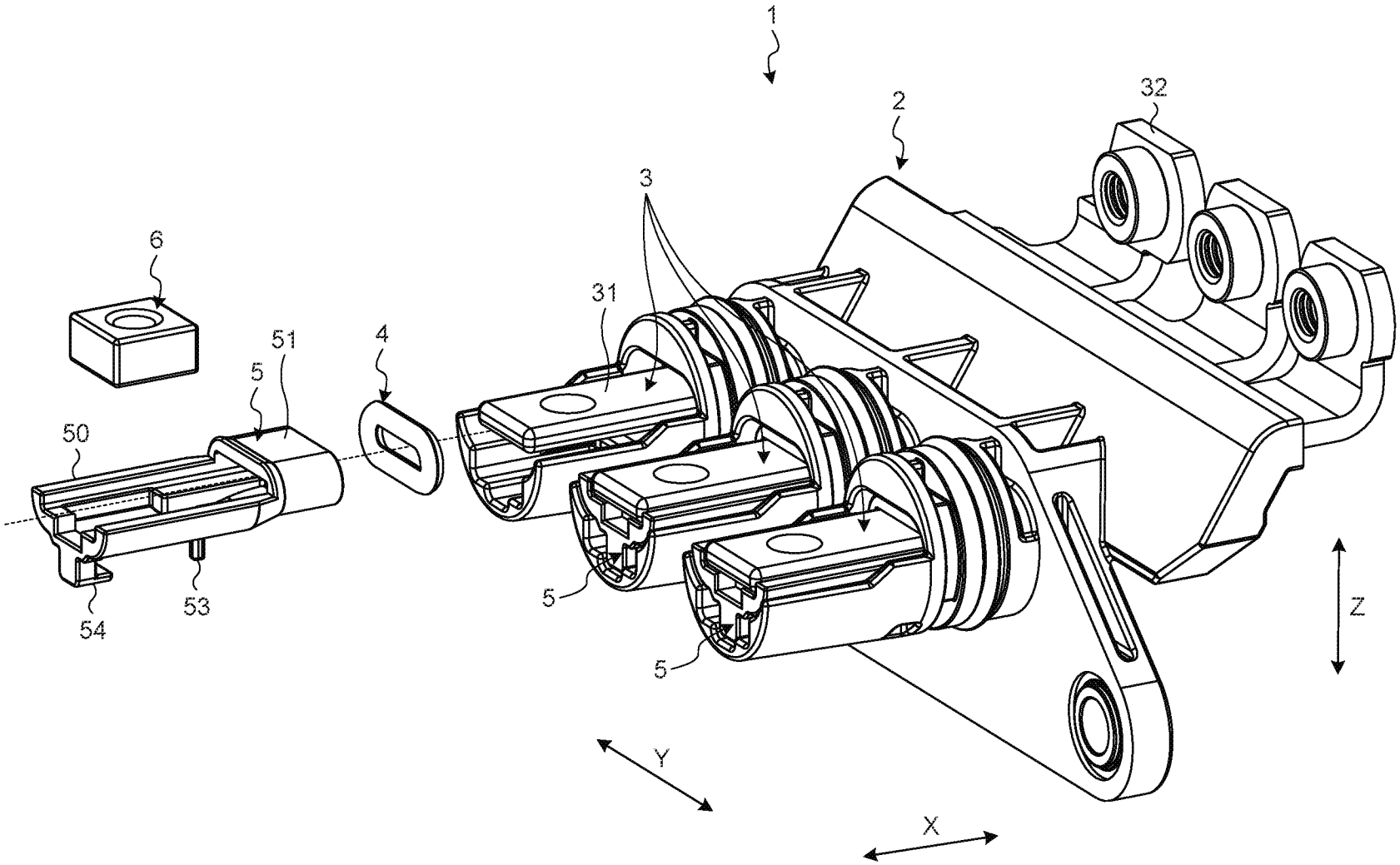
FIG. 3 is an exploded perspective view of the connector according to the embodiment.
Figure 4:
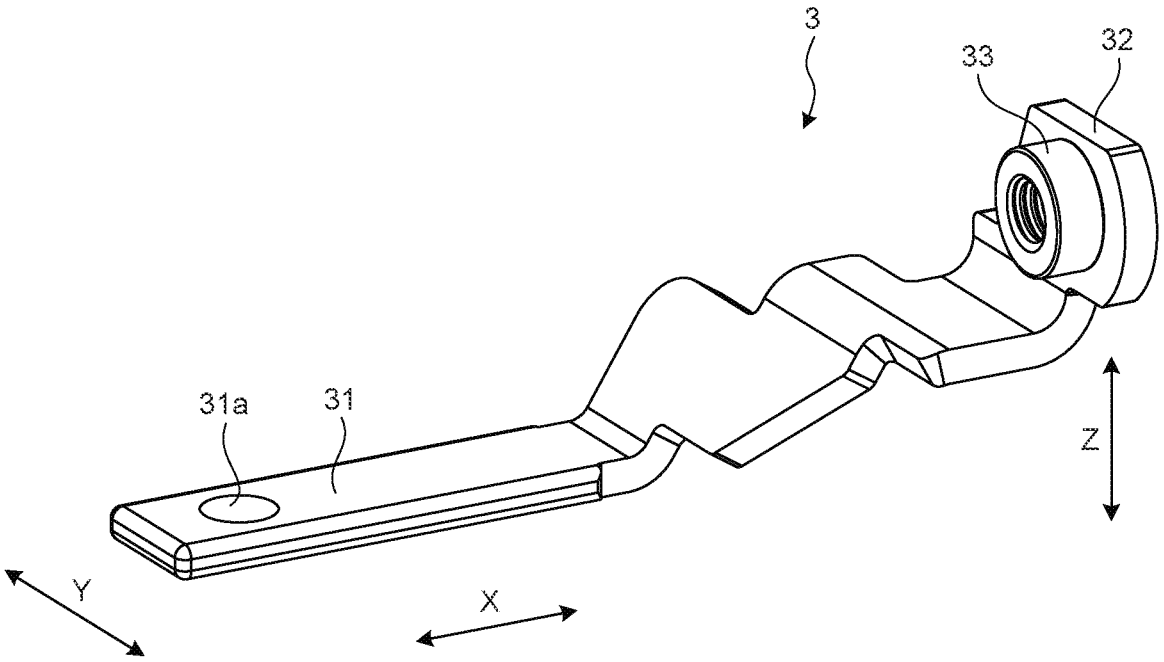
FIG. 4 is a perspective view of a conductor according to the embodiment.
Figure 7:
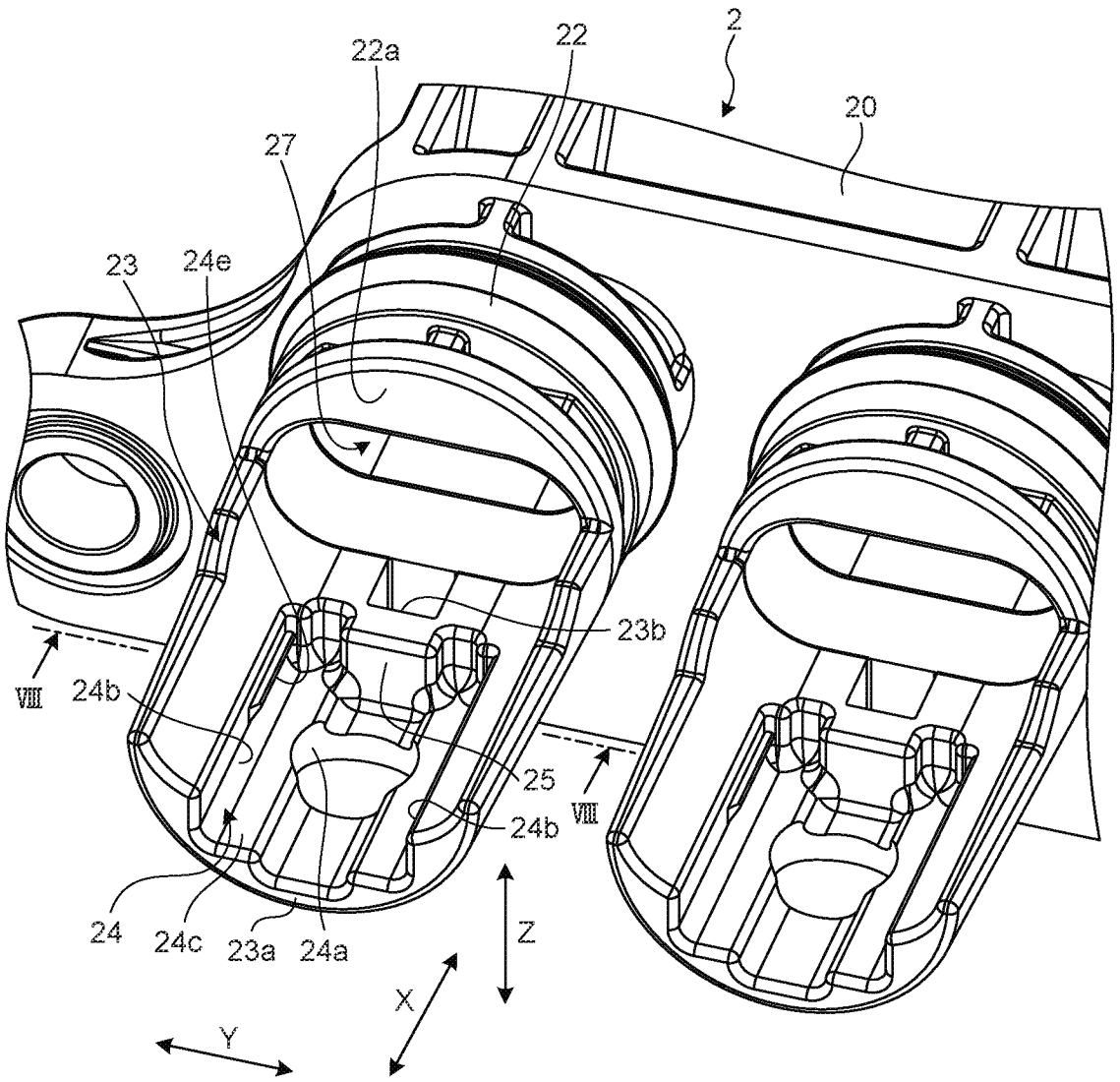
FIG. 7 is a perspective view of the housing according to the embodiment.
Figure 8:
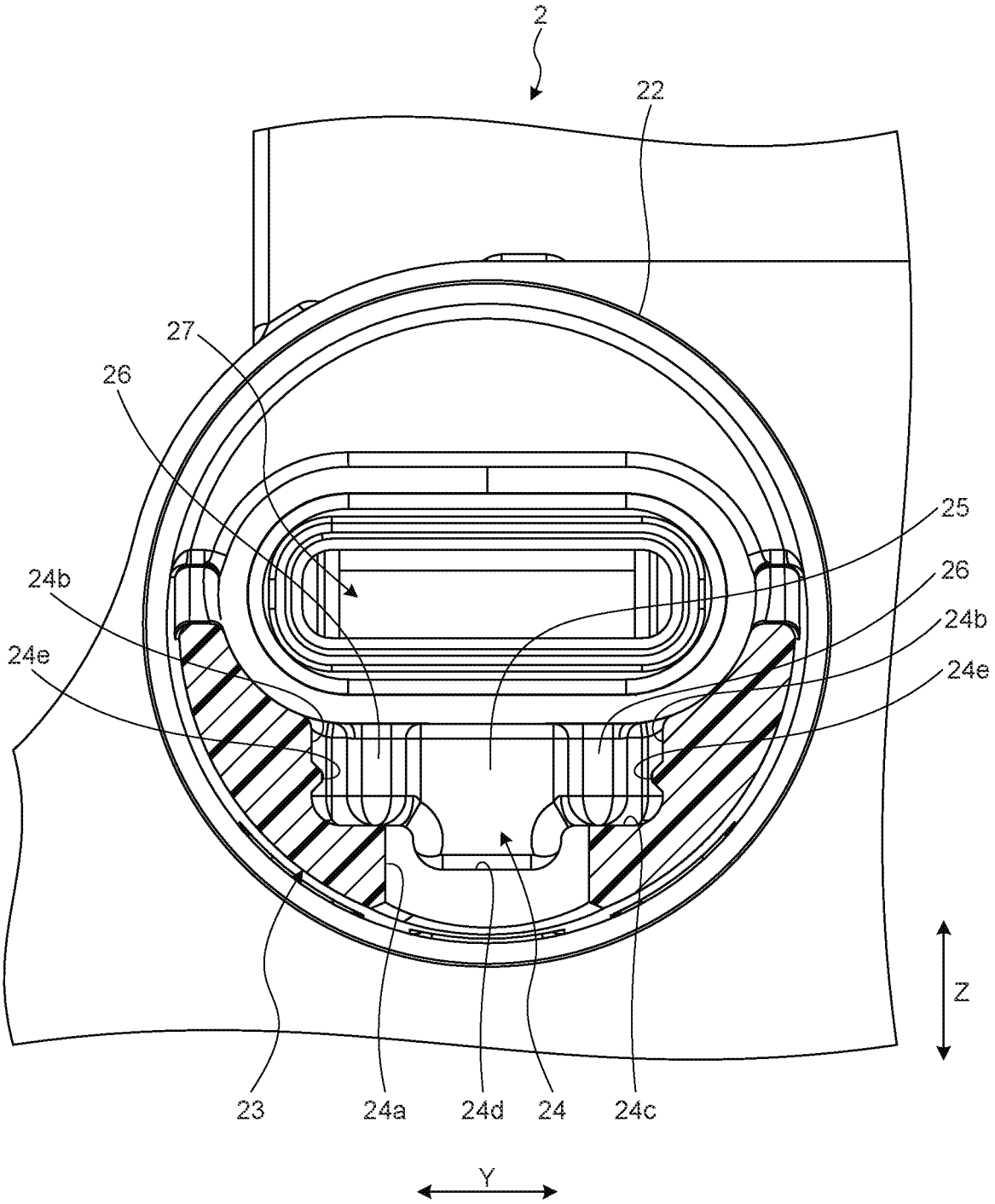
FIG. 8 is a cross-sectional view of the housing according to the embodiment.
Figure 9:
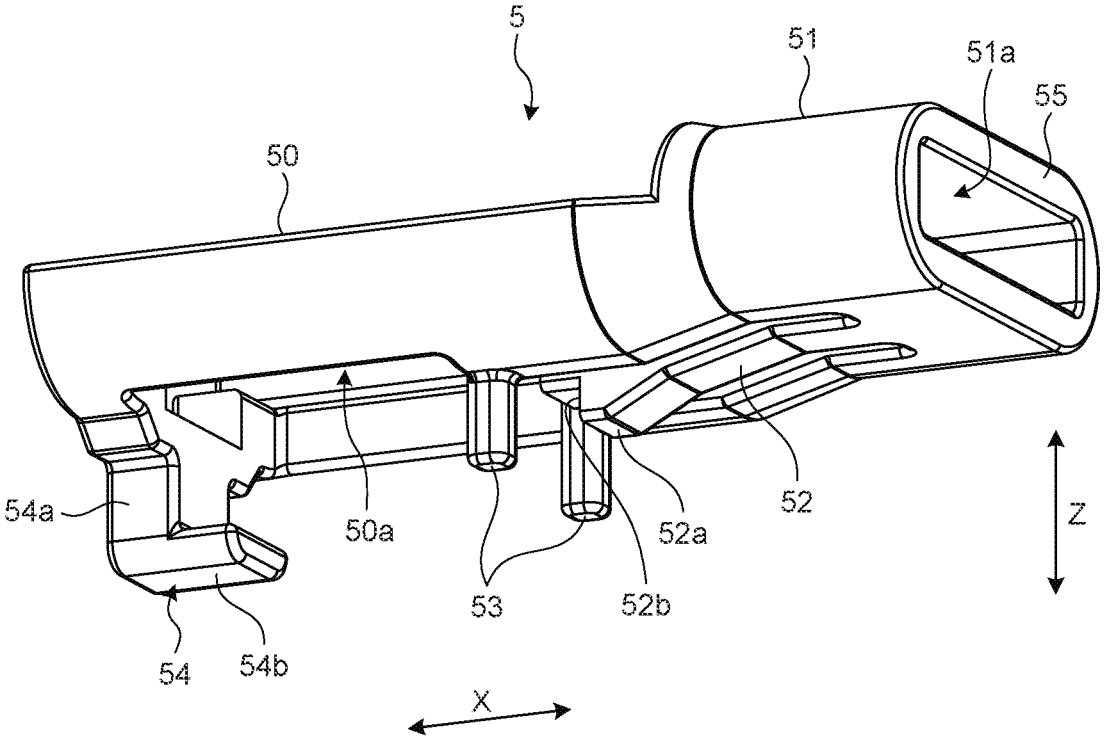
FIG. 9 is a perspective view of a support member according to the embodiment.
Figure 10:
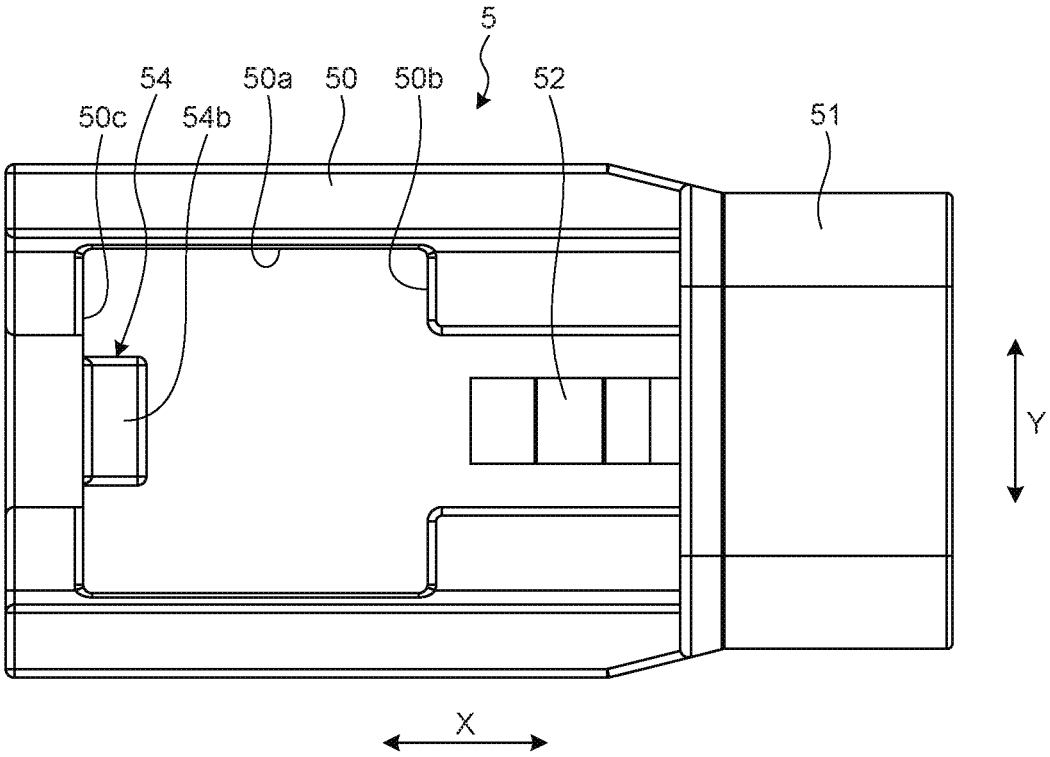
FIG. 10 is a plan view of the support member according to the embodiment.

An embodiment will be described with reference to FIGS. 1 to 21. The present embodiment relates to a connector. FIG. 1 is a view illustrating an arrangement example of a connector according to the embodiment, FIG. 2 is a perspective view of the connector according to the embodiment, FIG. 3 is an exploded perspective view of the connector according to the embodiment, FIG. 4 is a perspective view of a conductor according to the embodiment, FIG. 5 is a plan view of a housing and the conductor according to the embodiment, FIG. 6 is a cross-sectional view of the housing and the conductor according to the embodiment, FIG. 7 is a perspective view of the housing according to the embodiment, FIG. 8 is a cross-sectional view of the housing according to the embodiment, FIG. 9 is a perspective view of a support member according to the embodiment, and FIG. 10 is a plan view of the support member according to the embodiment.

Figure 11:
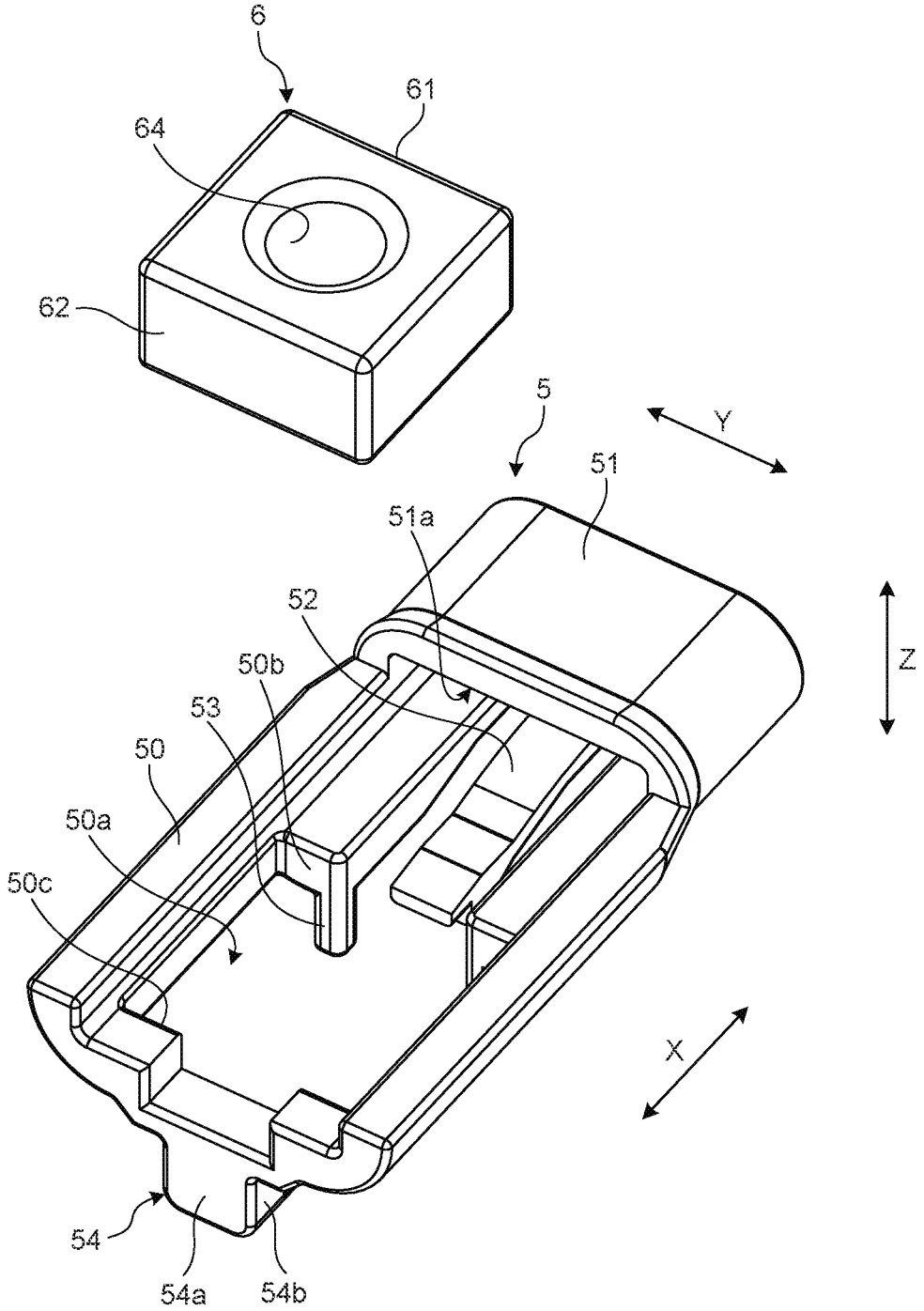
FIG. 11 is a perspective view of the support member and a nut according to the embodiment.
Figure 12:
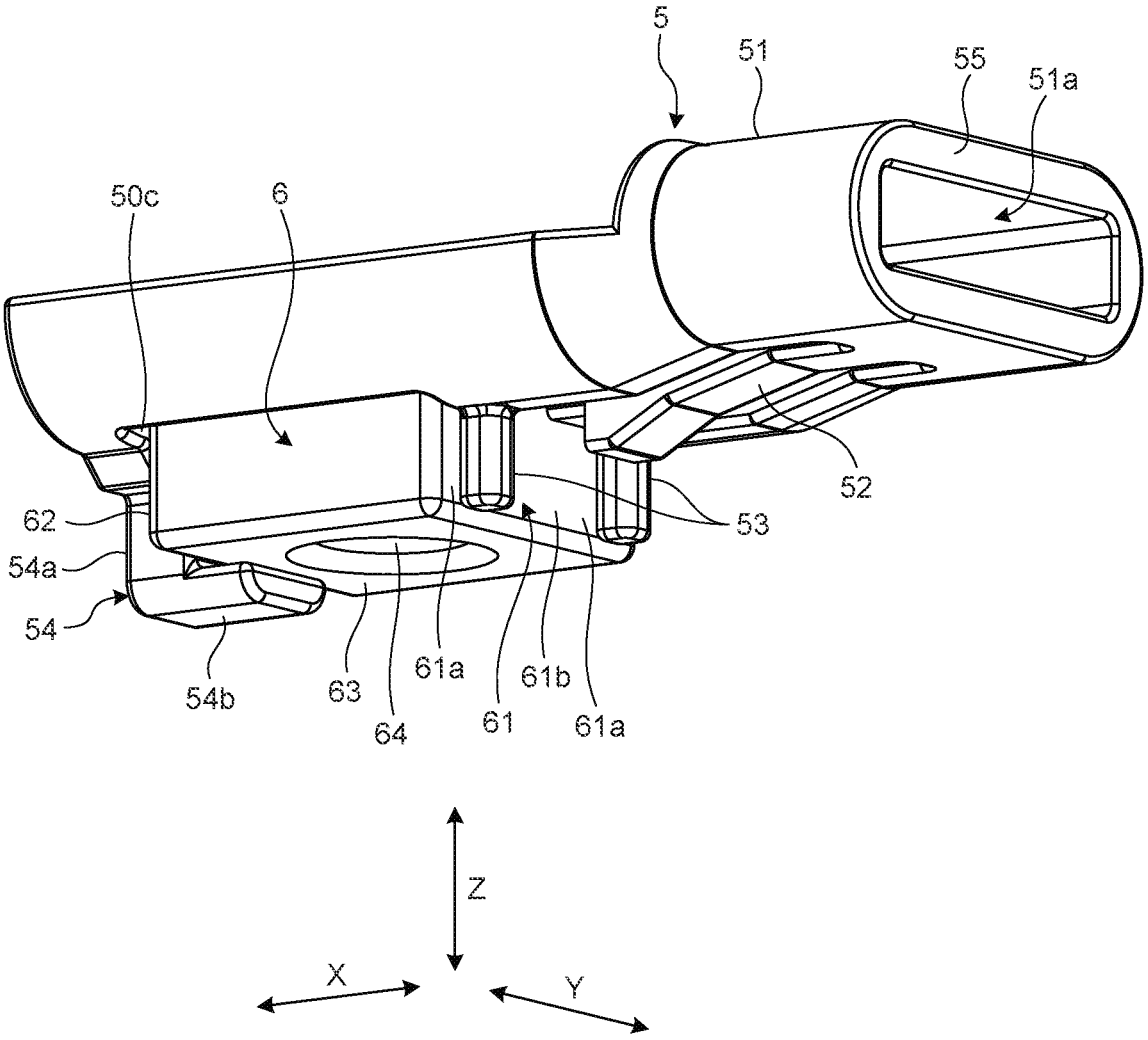
FIG. 12 is a perspective view of the support member and the nut according co the embodiment.
Figure 13:
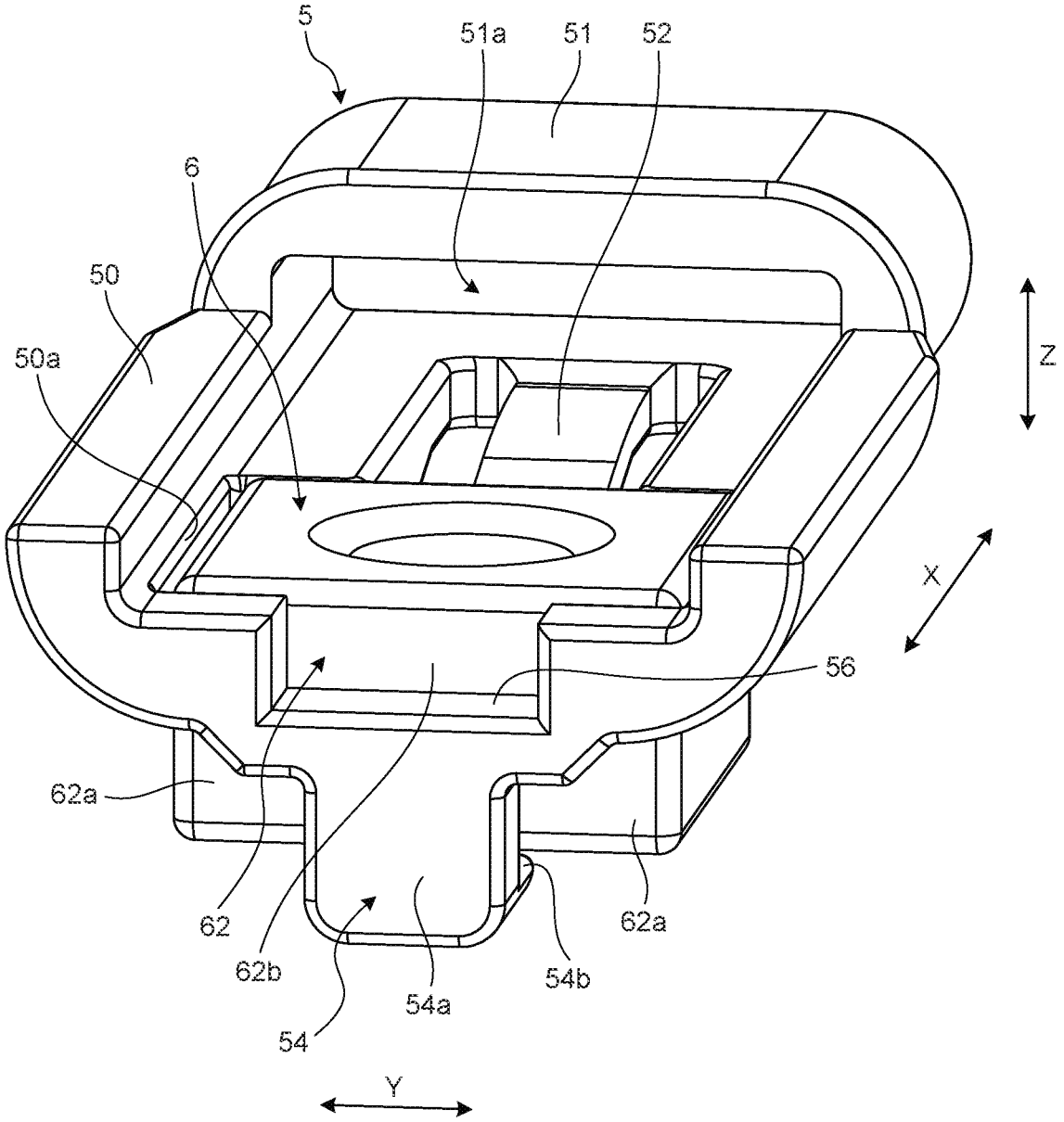
FIG. 13 is a perspective view of the support member and the nut according to the embodiment.
Figure 14:
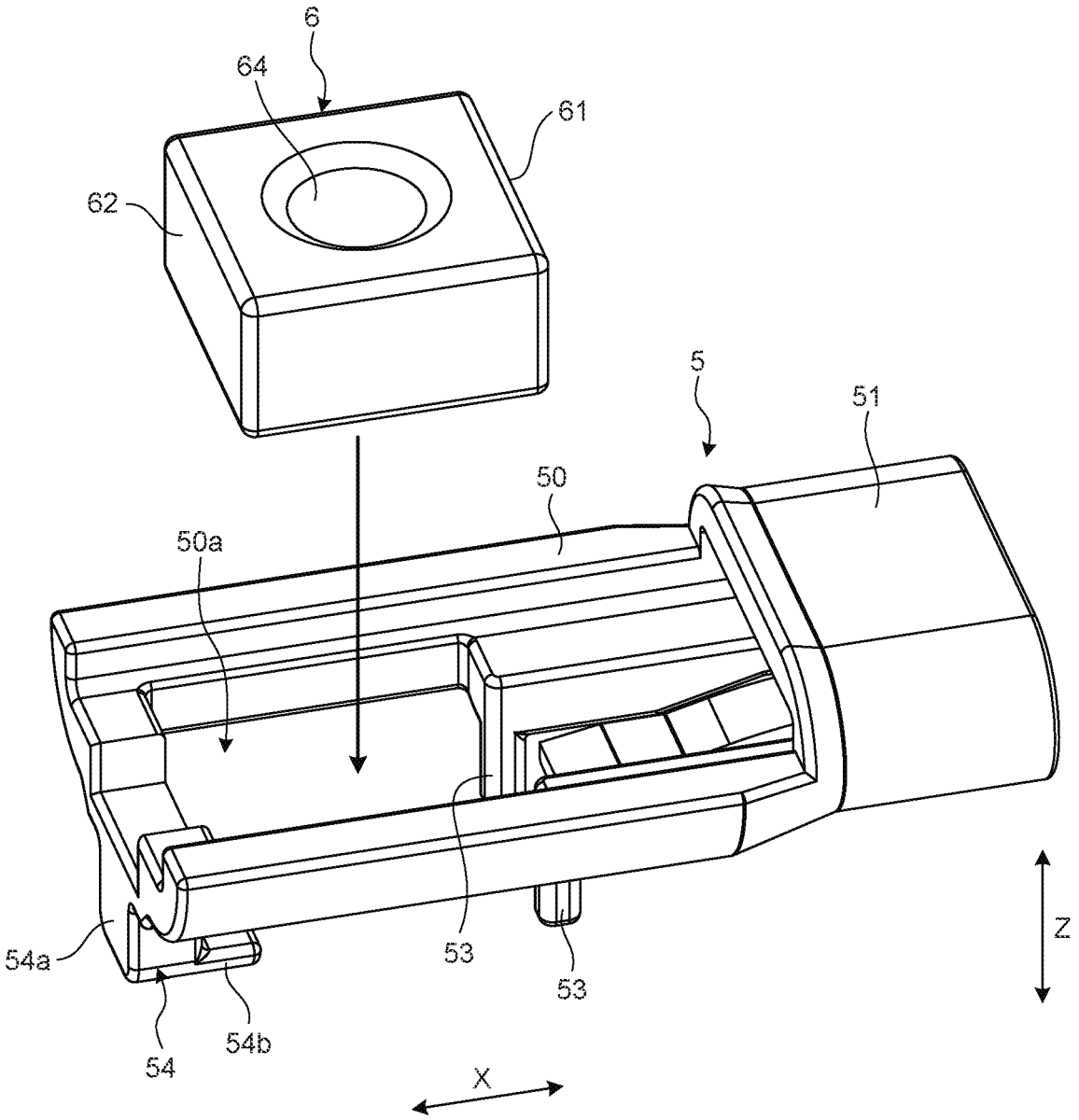
FIG. 14 is a perspective view relating to a process of placing the nut.
Figure 15:
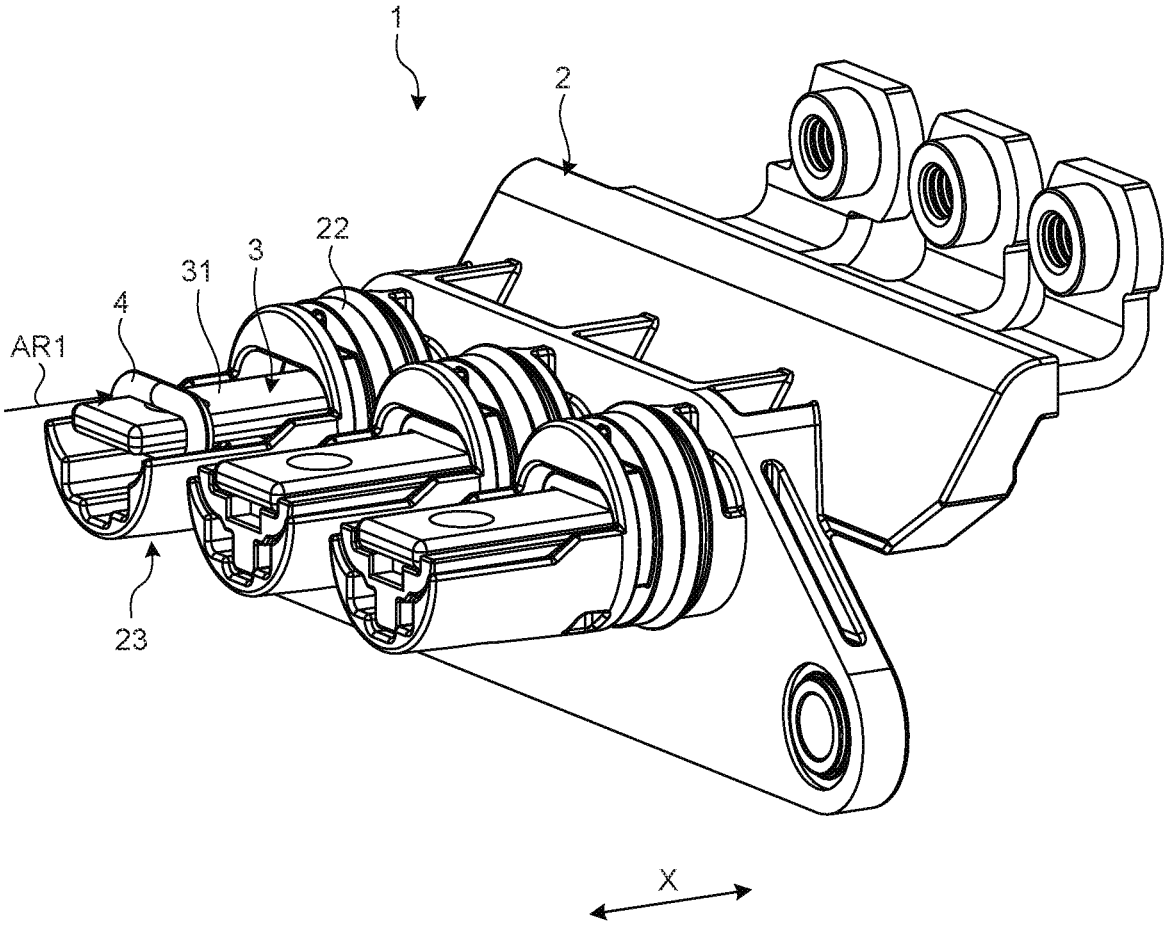
FIG. 15 is a perspective view relating to a first insertion process.
Figure 16:
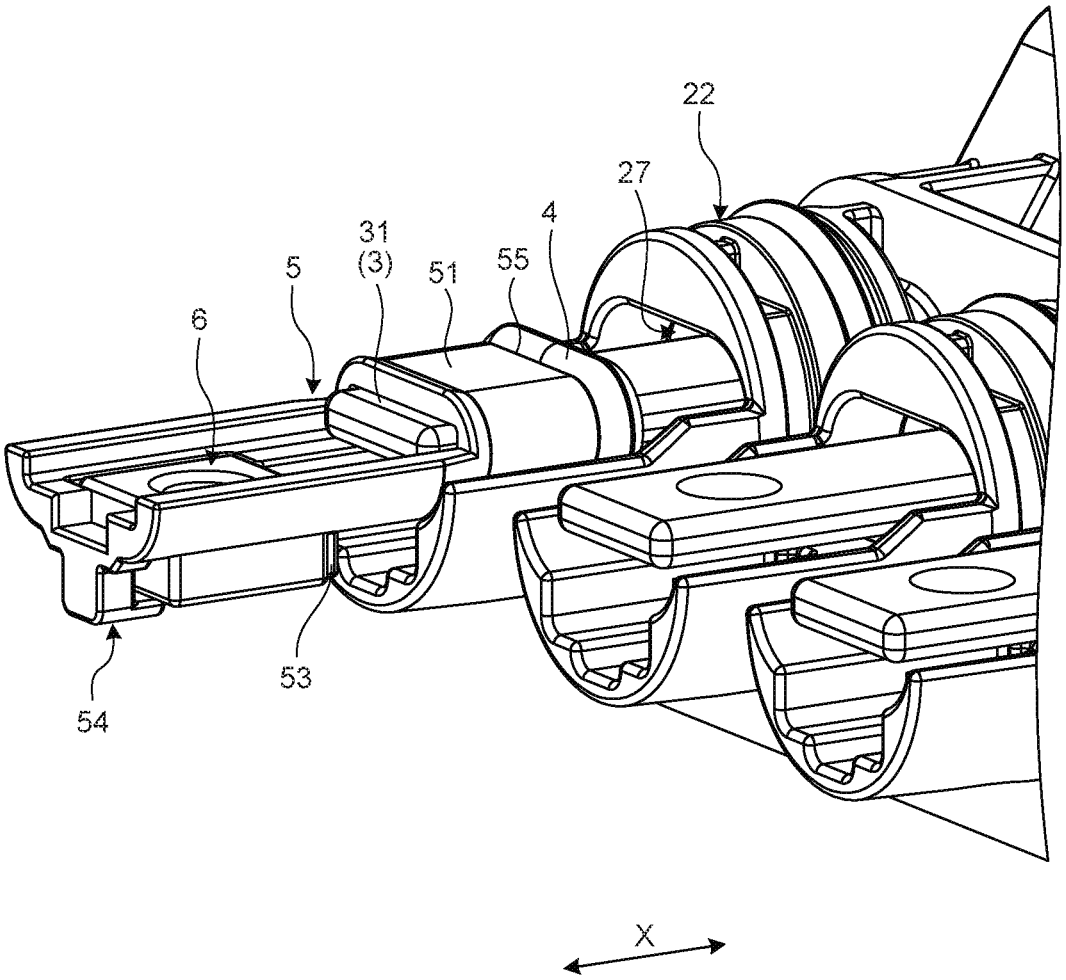
FIG. 16 is a perspective view relating to a second insertion process.
Figure 17:
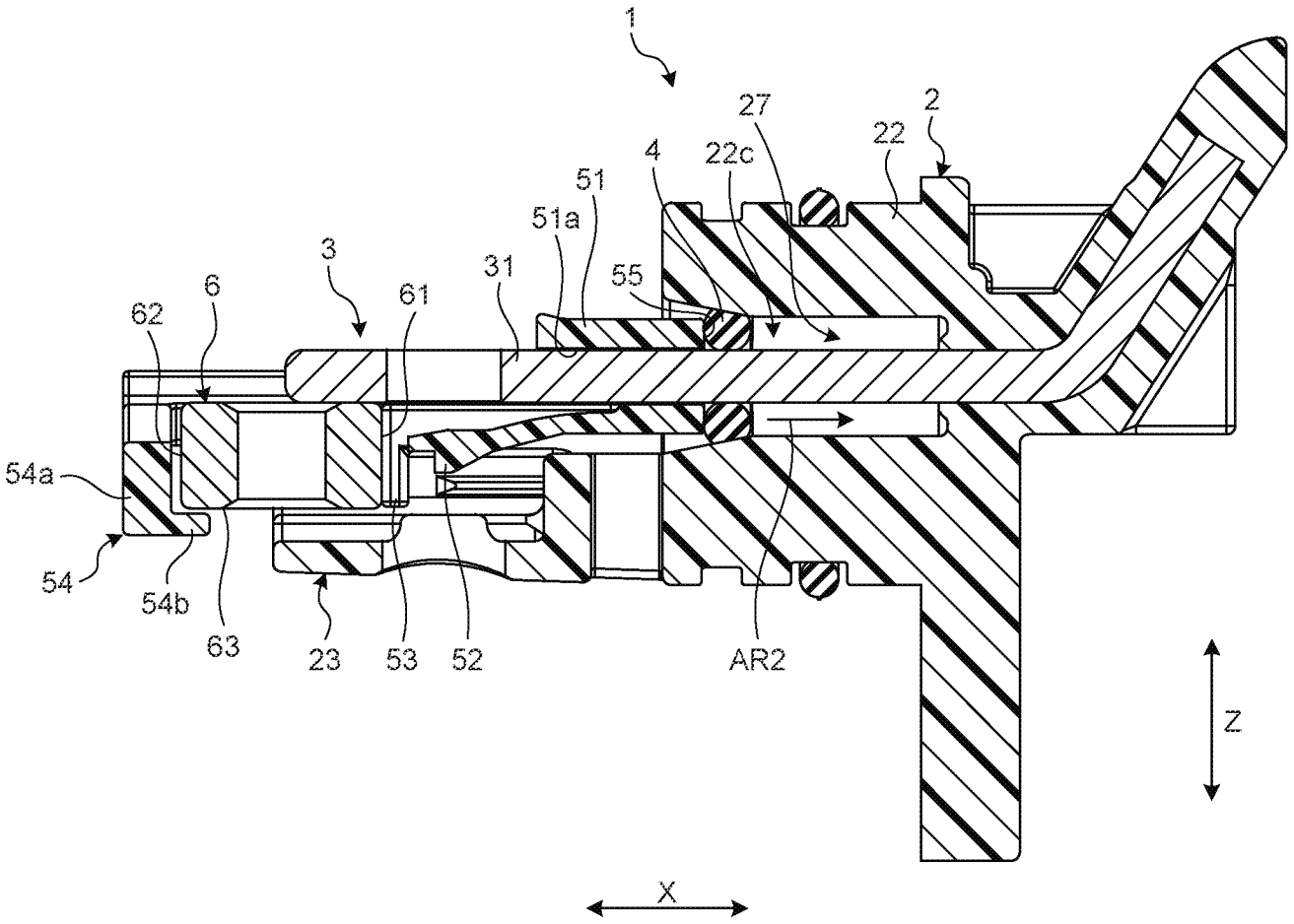
FIG. 17 is a cross-sectional view relating to a process of pushing-in a seal member.
Figure 18:
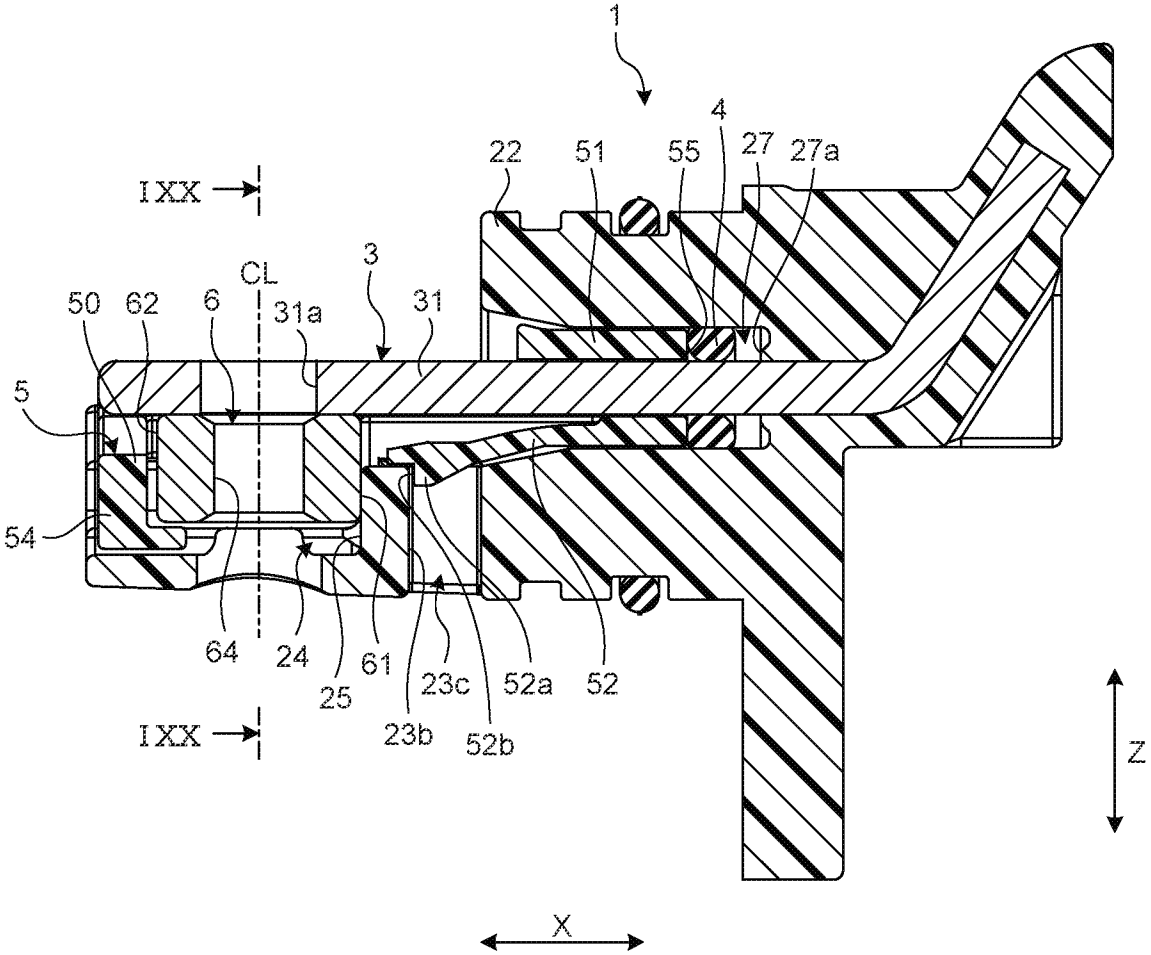
FIG. 18 is a cross-sectional view relating to an engagement process.
Figure 19:
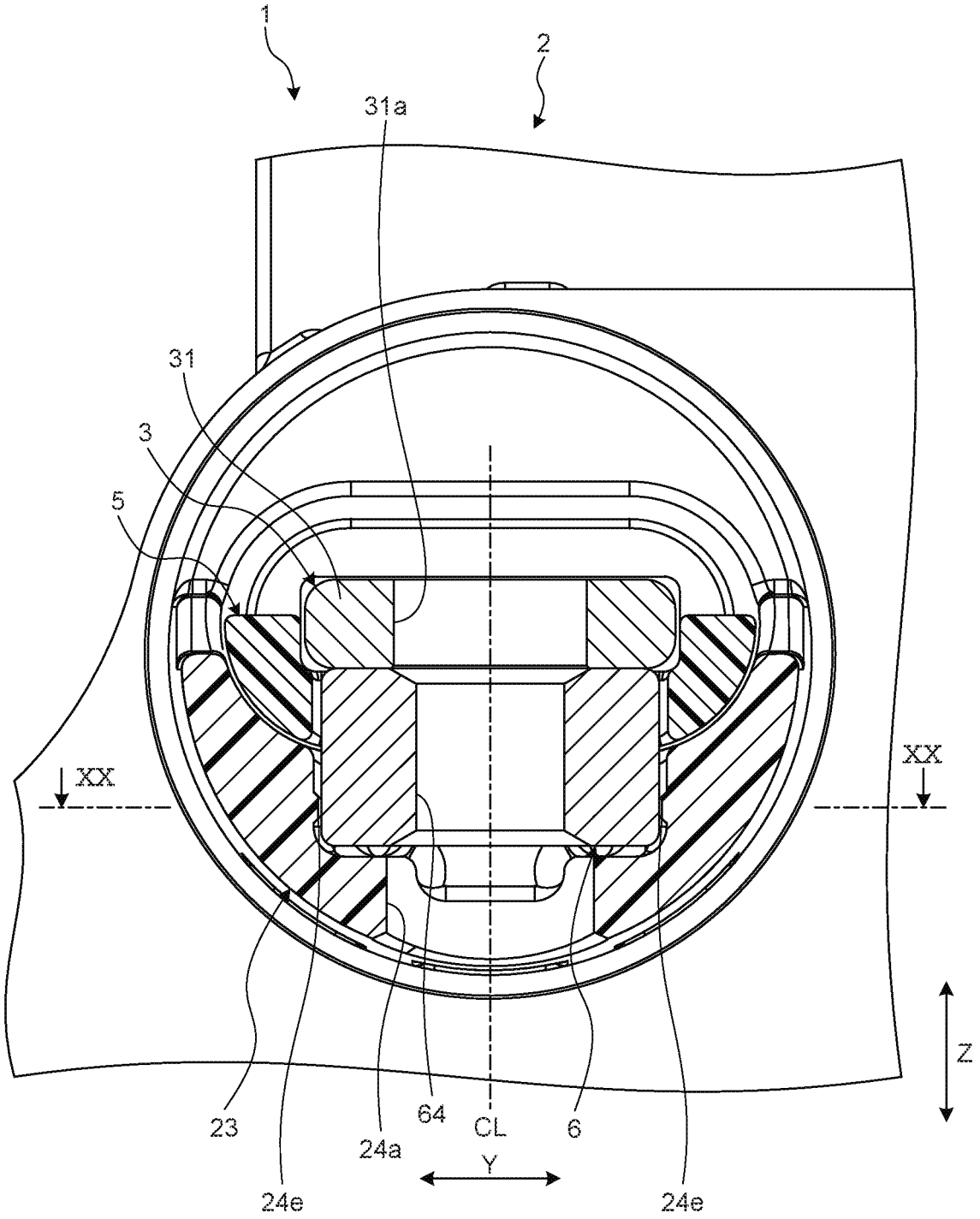
FIG. 19 is a cross-sectional view relating to a holding structure of the embodiment.
Figure 20:
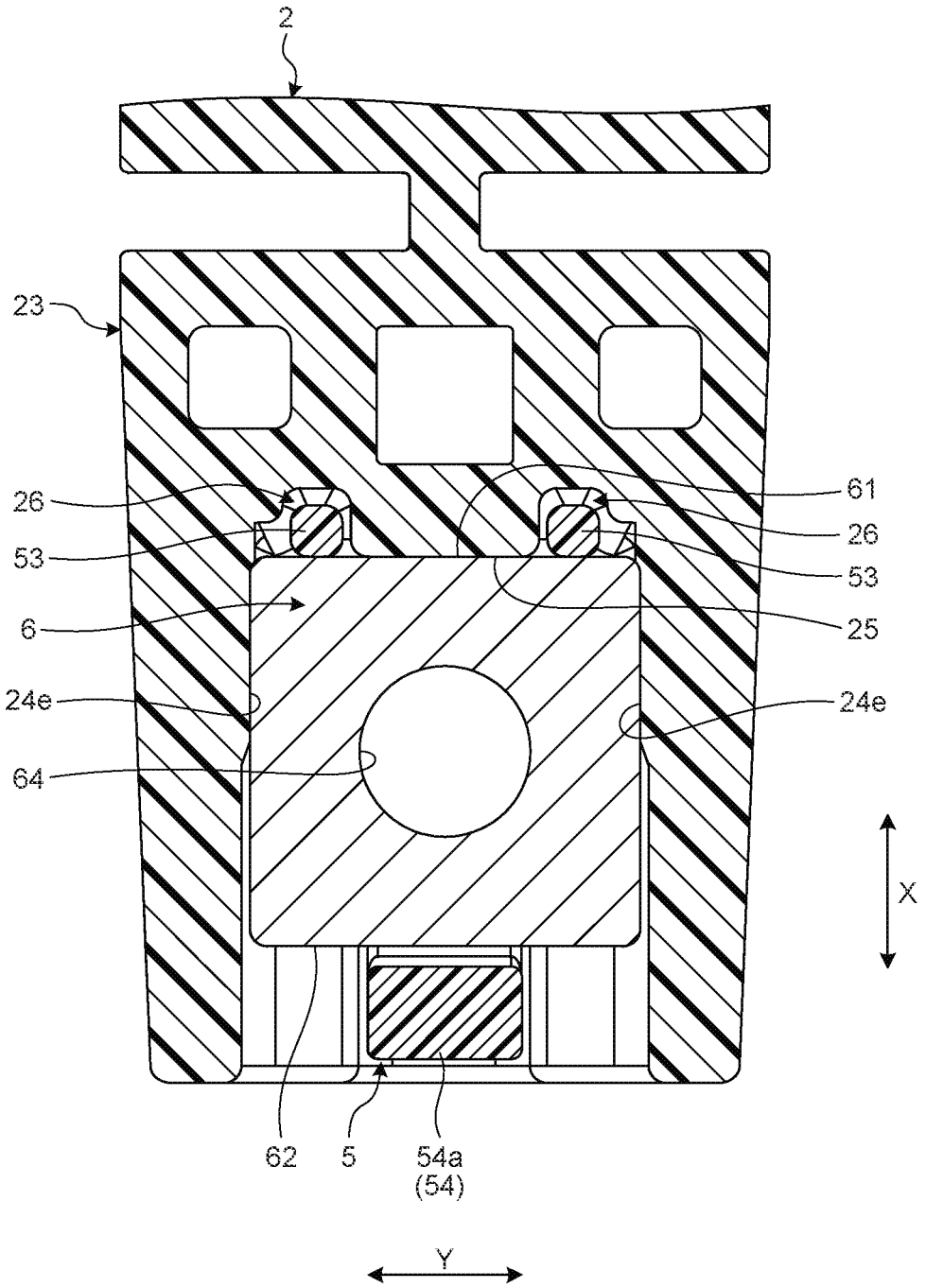
FIG. 20 is a cross-sectional view for explaining accommodation recesses according to the embodiment.
Figure 21:
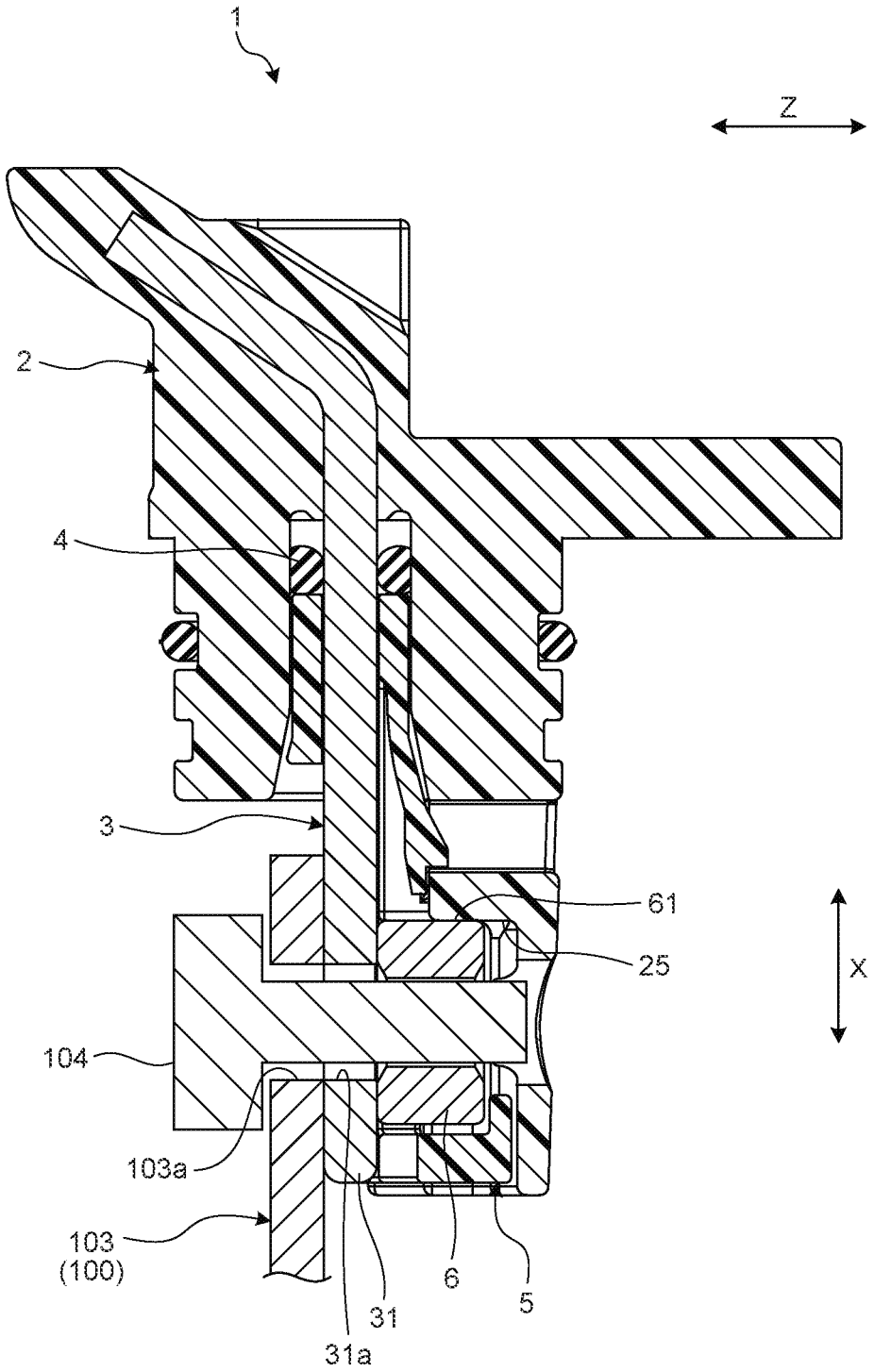
FIG. 21 is a cross-sectional view relating to a fastening process of the embodiment.

FIG. 11 is a perspective view of the support member and a nut according to the embodiment, FIG. 12 is a perspective view of the support member and the nut according to the embodiment, FIG. 13 is a perspective view of the support member and the nut according to the embodiment, FIG. 14 is a perspective view relating to a process of placing the nut, FIG. 15 is a perspective view relating to a first insertion process, FIG. 16 is a perspective view relating to a second insertion process, FIG. 17 is a cross-sectional view relating to a process of pushing-in a seal member, FIG. 18 is a cross-sectional view relating to an engagement process, FIG. 19 is a cross-sectional view relating to a holding structure of the embodiment, FIG. 20 is a cross-sectional view for explaining accommodation recesses according to the embodiment, and FIG. 21 is a cross-sectional view relating to a fastening process of the embodiment.

Figure 5:
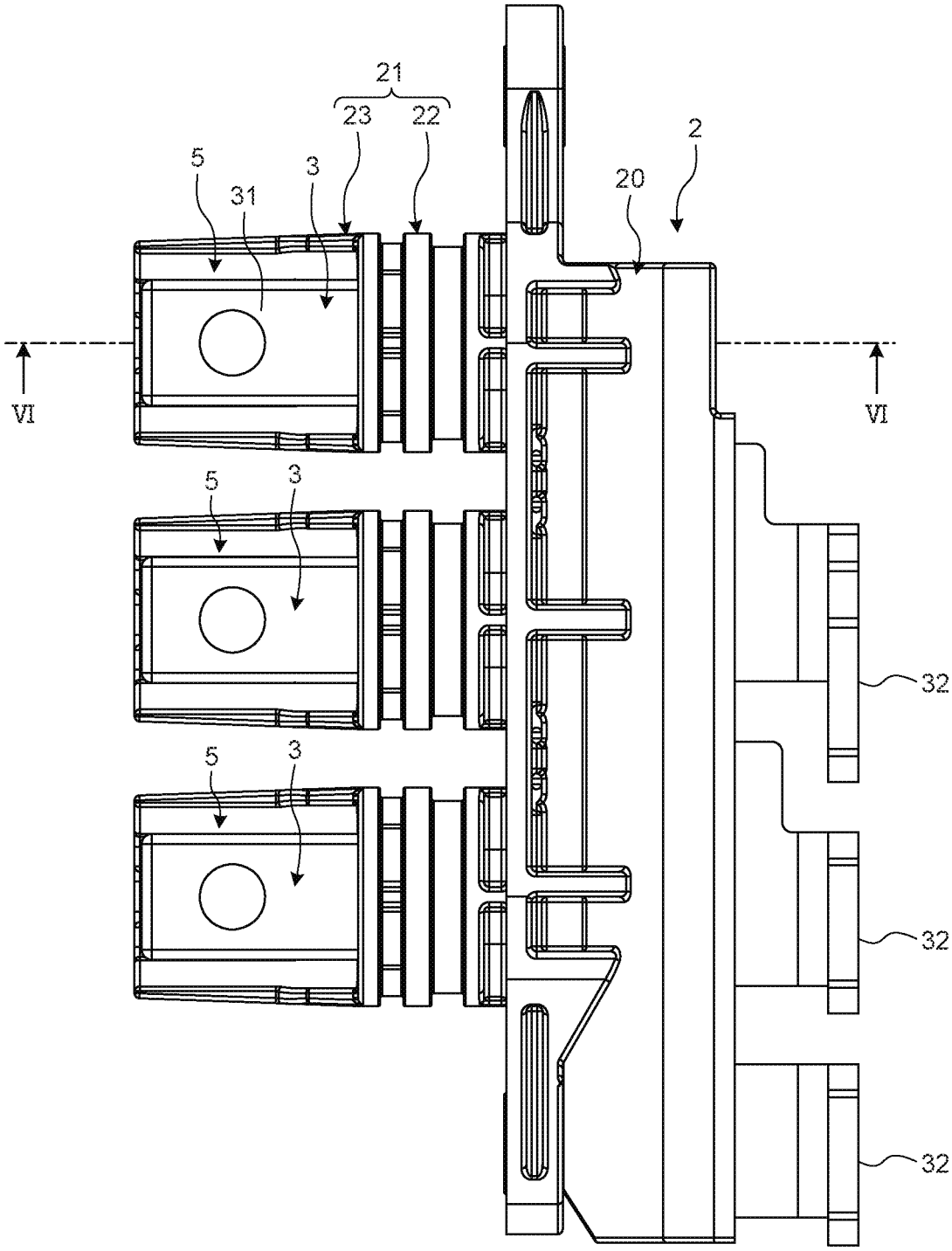
FIG. 5 is a plan view of a housing and the conductor according to the embodiment.
Figure 6:
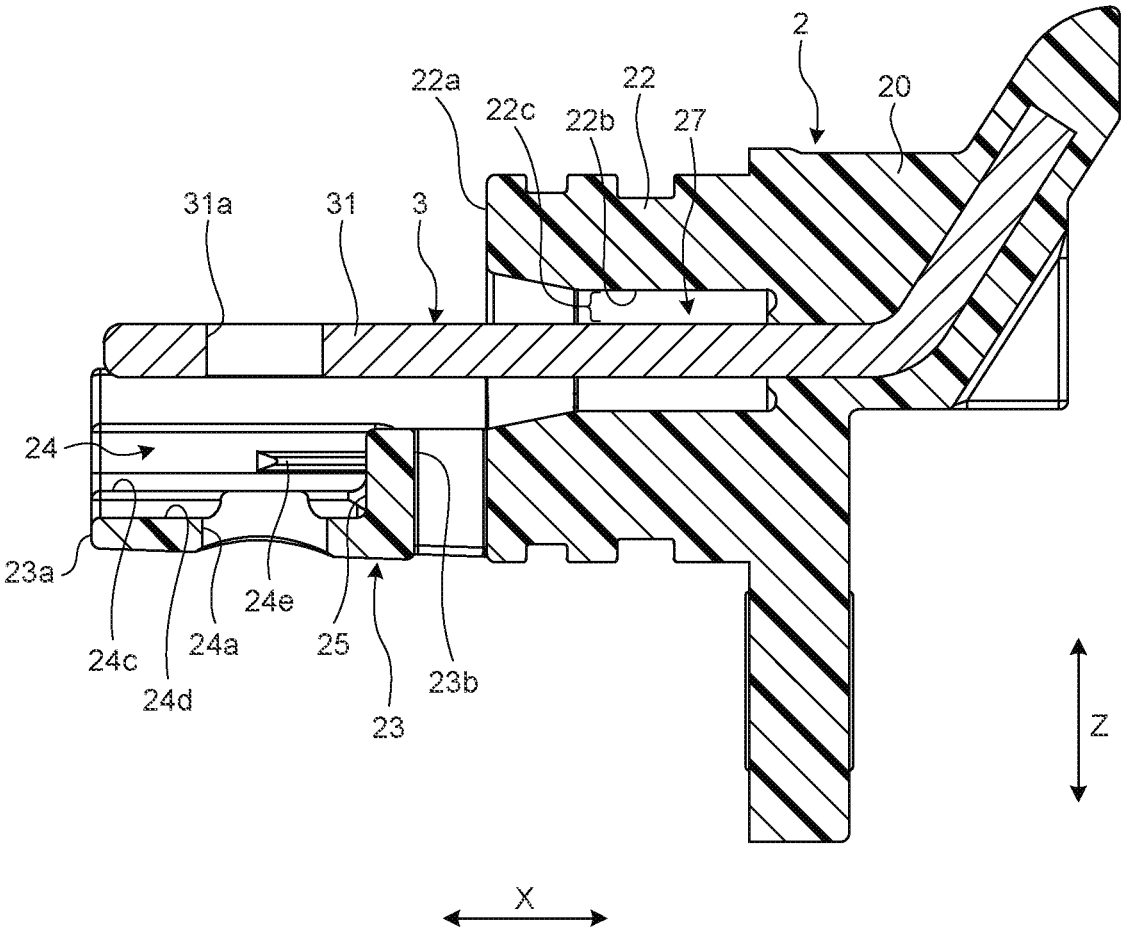
FIG. 6 is a cross-sectional view of the housing and the conductor according to the embodiment.

FIG. 6 illustrates a cross section taken along line VI-VI of FIG. 5. FIG. 8 illustrates a cross section taken along line VIII-VIII of FIG. 7. FIGS. 17 and 18 illustrate cross sections at the same position as FIG. 6. FIG. 19 illustrates a cross section taken along line IXX-IXX of FIG. 18. FIG. 20 illustrates a cross section taken along line XX-XX of FIG. 19.

As illustrated in FIG. 1, a connector 1 according to the present embodiment electrically connects a first device 100 and a second device 200 to each other. The first device 100 and the second device 200 are, for example, devices mounted on a vehicle. In the present embodiment, the first device 100 is a motor, and the second device 200 is an inverter. The first device 100 includes a case 101 and a motor main body 102. The second device 200 includes a case 201 and an inverter main body 202. An opening 101*a* is formed in an upper portion of the case 101. An opening 201*a* facing the opening 101*a* is formed in a lower portion of the case 201. The connector 1 is disposed in a communicating portion 10 where the opening 101*a* and the opening 201*a* communicate with each other. The connector 1 is fixed to, for example, the case 101 of the first device 100. A conductor 3 of the connector 1 has a first terminal portion 31 connected to the motor main body 102.

As illustrated in FIGS. 1 to 3, the connector 1 includes a housing 2, the conductor 3, a seal member 4, a support member 5, and a nut 6. In the present embodiment, the conductor 3, which is a plate-shaped metal conductor, is a so-called bus bar. The connector 1 includes, for example, a plurality of conductors 3. The seal member 4 is a packing that seals between the conductor 3 and the housing 2. The support member 5 is attached and fixed to the housing 2 in a state where the support member 5 holds the nut 6. The support member 5 has a function as a jig pushing-in the seal member 4 to a predetermined position.

As illustrated in FIG. 4, the conductor 3 includes the first terminal portion 31, a second terminal portion 32, and a second nut 33. The first terminal portion 31 is connected to the motor main body 102. The first terminal portion 31 has a rectangular flat plate shape. The first terminal portion 31 has a through hole 31*a* through which a fastening member such as a bolt is inserted. The through hole 31*a* is disposed, for example, in a distal end portion of the first terminal portion 31.

The second terminal portion 32 connected to the inverter main body 202. The second terminal portion 32 has a flat plate shape. The conductor 3 as illustrated is bent between the first terminal portion 31 and the second terminal portion 32. The second nut 33 is fixed to the second terminal portion 32. A terminal of the inverter main body 202 is fastened together with the second terminal portion 32 by a fastening member such as a bolt.

In the following description, a direction in which the first terminal portion 31 extends will be referred to as "the first direction X". In addition, a width direction of the first terminal portion 31 will be referred to as "the second direction Y". In addition, a plate thickness direction of the first terminal portion 31 will be referred to as "the third direction Z". The first direction X, the second direction Y, and the third direction Z are orthogonal to each other. As illustrated in FIG. 1, etc., the plurality of conductors 3 are arranged in the second direction Y. The connector 1 is mounted on the vehicle, for example, so that the first terminal portion 31 extends in a vertical direction of the vehicle. In this case, the first terminal portion 31 protrudes downward from the housing 2.

The housing 2 is a member holding the conductor 3. The housing 2 is formed of, for example, an insulating synthetic resin. In the present embodiment, the housing 2 is integrally formed with the plurality of conductors 3. As illustrated in FIGS. 5 to 7, the housing 2 has a main body 20 and a protruding portion 21. The main body 20 and the protruding portion 21 are integrally formed. It should be noted that illustration of the conductor 3 is omitted in FIG. 7 to make it easy to understand the configuration of the protruding portion 21.

The main body 20 is a portion holding the conductor 3. The main body 20 is fixed to the case 101 of the first device 100 and supported by the case 101. The protruding portion 21 protrudes from the main body 20. The first terminal portion 31 is exposed to an external space from the main body 20 through the protruding portion 21. The second terminal portion 32 protrudes from the main body 20 in a direction opposite to the direction in which the protruding portion 21 protrudes. The housing 2 has one protruding portion 21 for one conductor 3.

As illustrated in FIGS. 5 to 7, the protruding portion 21 includes a cylindrical portion 22 and a holding portion 23. The cylindrical portion 22 is a proximal portion of the protruding portion 21. That is, the cylindrical portion 22 connected to the main body 20. The cylindrical portion 22 has a cylindrical shape. As illustrated in FIG. 6, a proximal end of the cylindrical portion 22 closed by the main body 20. The cylindrical portion 22 has a recess 27 surrounding the first terminal portion 31. The seal member 4 is pushed into the recess 27 to seal between the first terminal portion 31 and the housing 2.

The cylindrical portion 22 has a bottom, and is open only a side of the holding portion 23. When viewed in a cross section orthogonal to the first direction X, the cylindrical portion 22 has, for example, an oval shape. The cylindrical portion 22 surrounds a proximal portion of the first terminal portion 31. The distal end portion of the first terminal portion 31 protrudes from the cylindrical portion 22. An annular gap 22*c* is provided between an inner circumferential surface 22*b* of the cylindrical portion 22 and the first terminal portion 31 for the seal member 4 to be inserted thereinto.

The holding portion 23 protrudes from a distal end 22*a* of the cylindrical portion 22 in the first direction X. The holding portion 23 is configured to hold the nut 6, as will be described below. The holding portion 23 has a semi-cylindrical shape. The holding portion 23 has a holding recess 24 extending in the first direction X. The holding recess 24 is recessed in the first direction X from a distal end 23*a* of the holding portion 23 toward the cylindrical portion 22.

As illustrated in FIGS. 7 and 8, the holding recess 24 has an approximately rectangular cross-sectional shape. More specifically, the holding recess 24 has a pair of first wall surfaces 24*b* and 24*b* extending in the first direction X and a second wall surface 24*c* extending in the first direction X. The pair of first wall surfaces 24*b* and 24*b* faces each other in the second direction Y. The second wall surface 24*c* is a wall surface facing the third direction Z, and connects the pair of first wall surfaces 24*b* and 24*b* to each other. The pair of first wall surfaces 24*b* and 24*b* and the second wall surface 24*c* form a guide groove having an approximately rectangular cross-sectional shape. The holding recess 24 guides the support member 5 along the first direction X.

The second wall surface 24*c* is provided with a groove 24*d* extending in the first direction X. The groove 24*d* guides a second support piece 54 of the support member 5.

The holding recess 24 has a through hole 24*a*. The through hole 24*a* is disposed to be concentric with the through hole 31*a* of the conductor 3. The through hole 24*a* penetrates through a wall of the holding recess 24 in the third direction Z. The through hole 24*a* is open in the second wall surface 24*c*. An abutment surface 25 is provided deep in the first direction X in the holding recess 24. The abutment surface 25 is a position determining surface for determining a position of the nut 6 in the first direction X. The abutment surface 25 is a surface facing to the distal end 23*a* of the holding portion 23, and is, for example, orthogonal to the first direction X.

The holding portion 23 has accommodation recesses 26. The accommodation recesses 26 are adjacent to the abutment surface 25. The accommodation recesses 26 are portions accommodating first support pieces 53 of the support member 5. The accommodation recesses 26 are provided on both sides of the abutment surface 25 in the second direction Y, respectively. The accommodation recesses 26 are recessed with respect to the abutment surface 25 in the first direction X toward the cylindrical portion 22.

A linear rib 24*e* is provided on each of the pair of first wall surfaces 24*b* and 24*b*. The rib 24*e* is positioned deep in the first direction X on the first wall surface 24*b*. The rib 24*e* is a squashy rib extending in the first direction X. The rib 24*e* is squashed by the nut 6 when the nut 6 is press-fitted into the holding recess 24. The two ribs 24*e* face each other in the second direction Y.

As illustrated in FIG. 7, etc., the holding portion 23 has a locking surface 23*b* locking the support member 5. The locking surface 23*b* is positioned closer to the cylindrical portion 22 than the abutment surface 25. As illustrated in FIG. 6, the locking surface 23*b* is a wall surface in a through hole 23*c* positioned in the vicinity of the abutment surface 25. The through hole 23*c* penetrates through the holding portion 23 in the third direction Z.

As illustrated in FIGS. 9 to 13, the support member 5 includes a main body 50, an annular portion 51, a lock arm 52, a pair of first support pieces 53 and 53, and the second support piece 54. The main body 50, the annular portion 51, the lock arm 52, the first support pieces 53 and 53, and the second support piece 54 are integrally formed of, for example, an insulating synthetic resin. When viewed in a plan view, the main body 50 has a rectangular frame shape. The main body 50 has an opening 50*a* allowing the nut 6 to pass therethrough. The opening 50*a* has a rectangular shape.

The annular portion 51 is a portion configured to push the seal member 4 into the gap 22*c* between the housing 2 and the conductor 3 and support the seal member 4. The annular portion 51 protrudes from one side of the main body 50. The annular portion 51 has a through hole 51*a* through which the first terminal portion 31 is inserted. The annular portion 51 has a flat annular shape or a cylindrical shape. The through hole 51*a* has an elongated rectangular cross-sectional shape. A distal end surface of the annular portion is a support surface 55 pressing the seal member 4. The support surface 55 has an elongated annular shape corresponding to the shape of the seal member 4.

The first support pieces 53 and the second support piece 54 are piece portions supporting the nut 6. In the present embodiment, as illustrated in FIG. 11, the nut 6 is a quadrangular nut having a rectangular shape when viewed in a plan view. The first support pieces 53 are straight line-shaped piece portions supporting a first side surface 61 of the nut 6. The first side surface 61 is a side surface abutting against the abutment surface 25 of the housing 2. The first support pieces 53 protrude from a front end 50*b* of the opening 50*a* in the third direction Z. The front end 50*b* is an end portion located on a front side in an insertion direction when the support member 5 is inserted into the housing 2.

As illustrated in FIG. 12, the pair of first support pieces 53 and 53 are disposed to face end portions 61*a* and 61*a* of the first side surface 61. The end portions 61*a* are end portions of the first side surface 61 in the second direction Y. The first support pieces 53 support the end portions 61*a* of the first side surface 61. The pair of first support pieces 53 and 53 support the first side surface 61, with a central portion 61*b* of the first side surface 61 being exposed. The central portion 61*b* is a portion abutting against the abutment surface 25 of the housing 2. A length of the first support piece 53 corresponds to a thickness of the nut 6.

The second support piece 54 is a piece portion supporting a second side surface 62 and a main surface 63 of the nut 6. The second side surface 62 is a surface paired with the first side surface 61. The first side surface 61 and the second side surface 62 face opposite to each other. That is, the second side surface 62 is a surface facing to a side opposite to the abutment surface 25 side. The main surface 63 is one of surfaces in which a screw hole 64 has an opening.

The second support piece 54 protrudes from a rear end 50*c* of the opening 50*a*. The second support piece 54 is bent in an L shape. The second support piece 54 has a proximal end portion 54*a* connected to the main body 50 and a distal end portion 54*b*. The proximal end portion 54*a* protrudes from the main body 50 in the third direction Z. The distal end portion 54*b* protrudes from a distal end of the proximal end portion 54*a* in the first direction X. The proximal end portion 54*a* faces the second side surface 62 of the nut 6 in the first direction X and supports the second side surface 62. The distal end portion 54*b* faces the main surface 63 of the nut 6 in the third direction Z and supports the main surface 63.

As illustrated in FIG. 13, the proximal end portion 54*a* supports the nut 6, with at least a part of the second side surface 62 being exposed. More specifically, the proximal end portion 54*a* is configured to expose end portions 62*a* and 62*a* of the second side surface 62. That is, the proximal end portion 54*a* supports a central portion of the second side surface 62. In addition, the main body 50 of the support member 5 has a notch 56 exposing a central upper portion 62*b* of the second side surface 62. In other words, the second support piece 54 is disposed to expose the central upper portion 62*b* of the second side surface 62.

As illustrated in FIG. 9, etc., the lock arm 52 extends from the annular portion 51 toward the opening 50*a* along the first direction X. The lock arm 52 has flexibility, and thus can be flexurally deformed in the third direction Z. A protrusion 52*a* protruding in the third direction Z is provided at a distal end portion of the lock arm 52. The protrusion 52*a* has an opposing surface 52*b* locked by the locking surface 23*b* of the housing 2.

As illustrated in FIG. 3, etc., the seal member 4 has an annular shape. The seal member 4 as illustrated is formed in an oval shape so that the first terminal portion 31 of the conductor 3 can be inserted therethrough. The seal member 4 is formed of, for example, a resin such as rubber. The seal member 4 is inserted into the gap 22*c* between the housing 2 and the first terminal portion 31 to seal between the first terminal portion 31 and the housing 2.

A connector manufacturing method according to the present embodiment includes a process of placing the nut 6, a first insertion process, a second insertion process, a process of pushing-in the seal member 4, and a process of engaging the support member 5 with the housing 2.

In the process of placing the nut 6, the nut 6 is placed on the support member 5. More specifically, the nut 6 is inserted into the opening 50*a* of the support member 5 as illustrated in FIG. 14. The nut 6 is placed on the distal end portion 54*b* of the second support piece 54. The support member 5 supports the nut 6 using the pair of first support pieces 53 and 53 and the second support piece 54. The process of placing the nut 6 is performed by, for example, an operator.

In the first insertion process, the conductor 3 held by the housing 2 is inserted through the seal member 4. More specifically, as illustrated in FIG. 15, the distal end portion of the first terminal portion 31 is inserted through the seal member 4. As indicated by arrow AR1 in FIG. 15, the first terminal portion 31 may be inserted through the seal member 4 by moving the seal member 4. The first insertion process is performed by, for example, an operator.

In the second insertion process, the conductor 3 is inserted into the annular portion 51 of the support member 5. More specifically, as illustrated in FIG. 16, the distal end portion of the first terminal portion 31 is inserted through the annular portion 51. The second insertion process is performed by, for example, an operator.

In the process of pushing-in the seal member 4, the seal member 4 is pushed into the recess 27 of the housing 2 by the annular portion 51 of the support member 5. As indicated by arrow AR2 in FIG. 17, the support surface 55 of the annular portion 51 pushes the seal member 4 into the recess 27. The seal member 4 is pushed into the gap 22*c* between the housing 2 and the first terminal portion 31 while being compressed. The process of pushing-in the seal member 4 is performed by, for example, an operator.

In the process of engaging the support member 5 with the housing 2 (hereinafter, simply referred to as "the engagement process".), the support member 5 is engaged with the housing 2. In the engagement process, the support member 5 is pushed-in to a position where the protrusion 52*a* of the lock arm 52 is engaged with the through hole 23*c* of the housing 2. In FIG. 18, the support member 5 engaged with the housing 2 is illustrated. The lock arm 52 is engaged with the housing 2 by the protrusion 52*a*. The opposing surface 52*b* of the protrusion 52*a* faces the locking surface 23*b* of the housing 2. The locking surface 23*b* restricts the support member 5 from moving in a direction in which the support member 5 is likely to come out of the housing 2. The engagement process is performed by, for example, an operator.

The support member 5 engaged with the housing 2 restricts the nut 6 from escaping from the housing 2. The main body 50 and the second support piece 54 of the support member 5 face the second side surface 62 of the nut 6 in the first direction X. Accordingly, when the nut 6 moves in a direction in which the nut 6 comes out of the holding recess 24, the support member 5 can lock the nut 6 and restrict the movement of the nut 6.

In the engagement process of the present embodiment, the nut 6 is pushed-in to a position where the first side surface 61 abuts the abutment surface 25 of the housing 2. The abutment surface 25 is a surface for positioning the screw hole 64 of the nut 6 to be concentric with the through hole 31*a* of the conductor 3. The housing 2 is designed such that the first side surface 61 abuts against the abutment surface 25 to position the screw hole 64 to be concentric with a center axis CL of the through hole 31*a*.

As illustrated in FIG. 19, the nut 6 is held by the ribs 24*e* of the housing 2. The pair of ribs 24*e* and 24*e* are squashed by the nut 6 when the nut 6 is press-fitted into the holding recess 24. The nut 6 is pushed into the holding recess 24 in the first direction X while squashing distal end portions of the ribs 24*e*. The ribs 24*e* are holding structures holding the nut 6 in a state where the first side surface 61 of the nut 6 abuts the abutment surface 25. The ribs 24*e* can suppress a positional deviation of the first side surface 61 with respect to the abutment surface 25.

As illustrated in FIG. 20, the first support pieces 53 of the support member 5 are accommodated in the accommodation recesses 26 of the housing 2. That is, the first support pieces 53 retreat into the accommodation recesses 26 when the first side surface 61 of the nut 6 abuts the abutment surface 25. The accommodation recesses 26 suppress interference between the first support pieces 53 and the housing 2 in the engagement process.

In the process of pushing-in the seal member 4 or in the engagement process, a force for pushing-in the nut 6 may be indirectly applied to the nut 6 via the support member 5, or may be directly applied to the nut 6 by a jig or the like. As described with reference to FIG. 13, the support member 5 exposes the end portions 62*a* and the central upper portion 62*b* of the second side surface 62. When the jig is used to push in the nut 6, the jig is pressed against the end portions 62*a* or the central upper portions 62*b*. A pressing force is directly applied to the nut 6, so that the first side surface 61 of the nut 6 can more reliably abut the abutment surface 25. In addition, a strength required for the support member 5 is smaller than that when the nut 6 is indirectly pressed via the support member 5. Accordingly, the support member 5 can be downsized.

FIG. 21 is a view relating to a fastening process of screwing a fastening member 104 into the nut 6. As illustrated in FIG. 21, a terminal 103 of the first device 100 is connected to the first terminal portion 31 of the conductor 3. The fastening member 104 is inserted through a through hole 103*a* of the terminal 103 and the through hole 31*a* of the first terminal portion 31 and screwed into the nut 6. The terminal 103 is fastened together with the first terminal portion 31 by the fastening member 104. In the fastening process, if the screw hole 64 of the nut 6 deviates from the through hole 31*a*, correction work or the like is required, resulting in a decrease in work efficiency. In the connector 1 of the present embodiment, since the screw hole 64 of the nut 6 is positioned at a normal position to correspondingly face the through hole 31*a*, workability during fastening work is improved.

As described above, the connector 1 according to the present embodiment includes the plate-shaped conductor 3, the housing 2, the nut 6, the support member 5, and the holding structure for holding the nut 6. The conductor 3 has the through hole 31*a* through which the fastening member 104 is inserted. The housing 2 holds the conductor 3 and has the abutment surface 25. The nut 6 has the screw hole 64 into which the fastening member 104 is screwed. The nut 6 is fixed to the housing 2 along the first direction X, which is a direction in which the conductor 3 extends. The support member 5 is a member fixed to the housing 2 and restricting the nut 6 from falling off the housing 2.

The abutment surface 25 is a surface configured to position the screw hole 64 concentric with the through hole 31*a* in a state where the first side surface 61 of the nut 6 abuts the abutment surface 25. The holding structure holds the nut 6 in a state where the first side surface 61 of the nut 6 abuts the abutment surface 25. The connector 1 according to the present embodiment can improve the workability during the fastening work for screwing the fastening member 104 into the nut 6 by holding the nut 6 at a position to be concentric with the through hole 31*a*.

In the present embodiment, the holding structure has the holding recess 24 provided in the housing 2 and recessed in the first direction X to make the nut 6 be press-fitted thereinto. The abutment surface 25 is positioned deep in the holding recess 24. The holding recess 24 can hold the nut 6 press-fitted thereinto, with the first side surface 61 of the nut 6 abutting the abutment surface 25. The holding recess 24 may not have the ribs 24*e*. For example, the holding recess 24 may hold the nut 6 interposed between the pair of first wall surfaces 24*b* and 24*b*.

In the present embodiment, the holding structure has the ribs 24*e* provided on the first wall surfaces 24*b*. The first wall surfaces 24*b* are wall surfaces of the holding recess 24 along the first direction X. The ribs 24*e* are ribs squashed by the nut 6 when the nut 6 is press-fitted into the holding recess 24. The ribs 24*e* make it possible to reduce an insertion force required when the nut 6 is press-fitted into the holding recess 24.

In the present embodiment, the support member 5 has the support pieces 53 and 54 supporting the nut 6, and is fixed to the housing 2 in a state where the nut 6 is supported by the support pieces 53 and 54. Accordingly, the support member 5 and the nut 6 can be assembled to the housing 2 at one time.

In the present embodiment, the side surfaces of the nut 6 include the first side surface 61 abutting the abutment surface 25. As can be seen from FIG. 20, the first side surface 61 has a larger width in the second direction Y than a width of the abutment surface 25. The support pieces 53 and 54 of the support member 5 include the first support pieces 53. The first support pieces 53 face the end portions 61*a* of the first side surface 61 in the first direction X and support the first side surface 61. The housing 2 has the accommodation recesses 26. The accommodation recesses 26 are adjacent to the abutment surface 25 and accommodate the first support pieces 53. Accordingly, interference between the first support pieces 53 and the housing 2 is suppressed when the first side surface 61 abuts the abutment surface 25.

In the present embodiment, the side surfaces of the nut 6 include the second side surface 62. The second side surface 62 is a surface facing opposite to the first side surface 61. The support pieces 53 and 54 include the second support piece 54 facing the second side surface 62. The second support piece 54 supports the nut 6 such that a part of the second side surface 62 is exposed. Since the part of the second side surface 62 is exposed, a pressing force can be directly applied to the nut 6 by a jig or the like.

Modified Examples of Embodiment

The holding structure for holding the nut 6 is not limited to the press-fit structure between the nut 6 and the housing 2 of the above-described embodiment. For example, the holding structure may be a press-fit structure between the support member 5 and the housing 2. In this case, the support member 5 is press-fitted into the housing 2 in a state where the support member 5 supports the nut 6. The support member 5 is press-fitted to a position where the first side surface 61 of the nut 6 abuts the abutment surface 25.

The holding structure may include two or more of a first press-fit structure between the support member 5 and the nut 6, a second press-fit structure between the support member 5 and the housing 2, and a third press-fit structure between the nut 6 and the housing 2. In the first press-fit structure, the nut 6 is press-fitted into the support member 5. In the second press-fit structure, the support member 5 is press-fitted into the housing 2. In the third press-fit structure, the nut 6 is press-fitted into the housing 2.

The housing 2 may not be integrally formed with the conductor 3. In this case, the housing 2 preferably has a holding hole through which the conductor 3 is inserted. The conductor 3 is inserted through the holding hole of the housing 2 and held by the housing 2.

The contents disclosed in the embodiment and modified examples described above can be implemented in an appropriate combination.

In the connector according to the embodiment, a housing has an abutment surface for positioning a screw hole of the nut to be concentric with a through hole of a conductor. A holding structure holds the nut in a state where a side surface of the nut abuts the abutment surface. The connector of the embodiment is advantageous in that the nut can be positioned at a normal position.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a plate-shaped conductor having a through hole through which a fastening member is inserted;

a housing holding the conductor and having an abutment surface;

a nut having a screw hole into which the fastening member is screwed, and fixed to the housing along a first direction that is a direction in which the conductor extends;

a support member configured to be fixed to the housing and restrict the nut from falling off the housing; and a holding structure configured to hold the nut, wherein the abutment surface is a surface configured to position the screw hole concentric with the through hole in a state where a side surface of the nut directly contacts the abutment surface, and the holding structure holds the nut in a state where the side surface of the nut directly contacts the abutment surface.

2. The connector according to claim 1, wherein the holding structure has a holding recess provided in the housing and recessed in the first direction to make the nut be press-fitted into the holding recess, and the abutment surface is positioned deep in the holding recess.

3. The connector according to claim 2, wherein the holding structure has a rib that is provided on a wall surface of the holding recess along the first direction and is configured to be squashed by the nut when the nut is press-fitted into the holding recess.

4. The connector according to claim 1, wherein the support member has a support piece configured to support the nut, and is configured to be fixed to the housing in a state where the nut is supported by the support piece.

5. The connector according to claim 2, wherein the support member has a support piece configured to support the nut, and is configured to be fixed to the housing in a state where the nut is supported by the support piece.

6. The connector according to claim 3, wherein the support member has a support piece configured to support the nut, and is configured to be fixed to the housing in a state where the nut is supported by the support piece.

7. A connector comprising:

a plate-shaped conductor having a through hole through which a fastening member is inserted;

a housing holding the conductor and having an abutment surface;

a nut having a screw hole into which the fastening member is screwed, and fixed to the housing along a first direction that is a direction in which the conductor extends;

a support member configured to be fixed to the housing and restrict the nut from falling off the housing; and a holding structure configured to hold the nut, wherein the abutment surface is a surface configured to position the screw hole concentric with the through hole in a state where a side surface of the nut abuts the abutment surface, and the holding structure holds the nut in a state where the side surface of the nut abuts the abutment surface, wherein the support member has a support piece configured to support the nut, and is configured to be fixed to the housing in a state where the nut is supported by the support piece, side surfaces of the nut include a first side surface abutting the abutment surface, the first side surface has a larger width than a width of the abutment surface, the support piece include first support pieces facing end portions of the first side surface in the first direction and supporting the first side surface, and the housing has accommodation recesses adjacent to the abutment surface and configured to accommodate the first support pieces.

8. The connector according to claim 7, wherein the holding structure has a holding recess provided in the housing and recessed in the first direction to make the nut be press-fitted into the holding recess, and the abutment surface is positioned deep in the holding recess.

9. The connector according to claim 8, wherein the holding structure has a rib that is provided on a wall surface of the holding recess along the first direction and is configured to be squashed by the nut when the nut is press-fitted into the holding recess.

10. A connector comprising:

a plate-shaped conductor having a through hole through which a fastening member is inserted;

a housing holding the conductor and having an abutment surface;

a nut having a screw hole into which the fastening member is screwed, and fixed to the housing along a first direction that is a direction in which the conductor extends;

a support member configured to be fixed to the housing and restrict the nut from falling off the housing; and a holding structure configured to hold the nut, wherein the abutment surface is a surface configured to position the screw hole concentric with the through hole in a state where a side surface of the nut abuts the abutment surface, and the holding structure holds the nut in a state where the side surface of the nut abuts the abutment surface, wherein the support member has a support piece configured to support the nut, and is configured to be fixed to the housing in a state where the nut is supported by the support piece, side surfaces of the nut include a first side surface abutting the abutment surface and a second side surface facing opposite to the first side surface, the support piece include a second support piece facing the second side surface, and the second support piece is configured to support the nut such that a part of the second side surface is exposed.

11. The connector according to claim 10, wherein the holding structure has a holding recess provided in the housing and recessed in the first direction to make the nut be press-fitted into the holding recess, and the abutment surface is positioned deep in the holding recess.

12. The connector according to claim 11, wherein the holding structure has a rib that is provided on a wall surface of the holding recess along the first direction and is configured to be squashed by the nut when the nut is press-fitted into the holding recess.

13. The connector according to claim 10, wherein side surfaces of the nut include a first side surface abutting the abutment surface, the first side surface has a larger width than a width of the abutment surface, the support piece include first support pieces facing end portions of the first side surface in the first direction and supporting the first side surface, and the housing has accommodation recesses adjacent to the abutment surface and configured to accommodate the first support pieces.

14. The connector according to claim 11, wherein side surfaces of the nut include a first side surface abutting the abutment surface, the first side surface has a larger width than a width of the abutment surface, the support piece include first support pieces facing end portions of the first side surface in the first direction and supporting the first side surface, and the housing has accommodation recesses adjacent to the abutment surface and configured to accommodate the first support pieces.

15. The connector according to claim 12, wherein side surfaces of the nut include a first side surface abutting the abutment surface, the first side surface has a larger width than a width of the abutment surface, the support piece include first support pieces facing end portions of the first side surface in the first direction and supporting the first side surface, and the housing has accommodation recesses adjacent to the abutment surface and configured to accommodate the first support pieces.

* * * * *